US011744419B2

(12) United States Patent
Iwakami

(10) Patent No.: US 11,744,419 B2
(45) Date of Patent: Sep. 5, 2023

(54) CLEANER

(71) Applicant: MAKITA CORPORATION, Anjo (JP)

(72) Inventor: Junichi Iwakami, Anjo (JP)

(73) Assignee: MAKITA CORPORATION, Anjo (JP)

( * ) Notice: Subject to any disclaimer, the term of this patent is extended or adjusted under 35 U.S.C. 154(b) by 65 days.

(21) Appl. No.: 17/330,907

(22) Filed: May 26, 2021

(65) Prior Publication Data

US 2021/0401247 A1 Dec. 30, 2021

(30) Foreign Application Priority Data

Jun. 29, 2020 (JP) ..... 2020-112145

(51) Int. Cl.

| | |
|---|---|
| ***A47L 9/00*** | (2006.01) |
| ***A47L 9/28*** | (2006.01) |
| ***A47L 9/22*** | (2006.01) |
| ***A47L 5/24*** | (2006.01) |

(52) U.S. Cl.

CPC ..... *A47L 9/0081* (2013.01); *A47L 5/24* (2013.01); *A47L 9/22* (2013.01); *A47L 9/2842* (2013.01)

(58) Field of Classification Search

CPC ..... H02K 5/24; H02K 5/04; H02K 5/18–207; A47L 9/0081; A47L 5/24; A47L 9/22

See application file for complete search history.

(56) References Cited

U.S. PATENT DOCUMENTS

| | | | | |
|---|---|---|---|---|
| 5,293,664 | A * | 3/1994 | Lim | A47L 9/0081 15/326 |
| 5,894,629 | A * | 4/1999 | Kim | A47L 9/0081 15/326 |
| 6,070,289 | A * | 6/2000 | Lee | A47L 9/22 15/327.2 |
| 6,505,807 | B1 * | 1/2003 | Nolting | F16F 15/04 248/638 |
| 7,596,829 | B2 * | 10/2009 | Song | A47L 9/0081 15/326 |
| 8,464,392 | B2 * | 6/2013 | Sato | A47L 9/0081 15/327.2 |
| 8,689,397 | B2 * | 4/2014 | Van De Veen | A47L 9/0081 15/326 |
| 9,456,728 | B2 * | 10/2016 | Danestad | F04D 29/444 |
| 9,693,662 | B2 * | 7/2017 | Tadina | A47L 9/0081 |
| 9,848,745 | B2 * | 12/2017 | Hill | F04D 29/668 |
| 10,374,482 | B2 * | 8/2019 | Wolf | F04D 25/06 |

(Continued)

FOREIGN PATENT DOCUMENTS

| | | | | |
|---|---|---|---|---|
| CN | 106468286 | A * | 3/2017 | A47L 5/22 |
| CN | 108852151 | A * | 11/2018 | A47L 5/12 |

(Continued)

*Primary Examiner* — Don M Anderson
*Assistant Examiner* — Jonathan R Zaworski
(74) *Attorney, Agent, or Firm* — Oliff PLC

(57) ABSTRACT

A cleaner reduces noise. The cleaner includes a motor assembly including a motor and a fan rotatable about a rotation axis with a rotational force generated by the motor, (Continued)

a cover surrounding the motor assembly, a guide that guides air from the fan at least partially to an outer surface of the cover, and a rib assembly that guides the air guided by the guide at least partially in a circumferential direction about the rotation axis along the outer surface of the cover.

13 Claims, 22 Drawing Sheets

(56) References Cited

U.S. PATENT DOCUMENTS

| | | | | |
|---|---|---|---|---|
| 10,455,998 | B2 * | 10/2019 | Kim | A47L 9/10 |
| 10,524,626 | B2 * | 1/2020 | Ni | A47L 9/0081 |
| 10,575,695 | B2 * | 3/2020 | Lee | F04D 29/44 |
| 11,033,163 | B2 * | 6/2021 | Sakuma | A47L 5/24 |
| 2005/0138755 | A1 * | 6/2005 | Ju | A47L 9/0081 15/326 |
| 2006/0277711 | A1 * | 12/2006 | Hong | A47L 9/0081 15/326 |
| 2007/0243087 | A1 * | 10/2007 | Burnham | F04D 29/5806 417/423.2 |
| 2010/0223751 | A1 * | 9/2010 | Liddell | A47L 9/22 15/326 |
| 2015/0128375 | A1 * | 5/2015 | Tadina | A47L 9/22 15/326 |
| 2019/0069737 | A1 | 3/2019 | Sakuma et al. | |
| 2019/0069741 | A1 * | 3/2019 | Murakami | A47L 9/102 |

FOREIGN PATENT DOCUMENTS

| | | | | |
|---|---|---|---|---|
| DE | 19617265 | A1 * | 8/1997 | A47L 9/0081 |
| DE | 10221443 | A1 * | 12/2003 | A47L 9/0081 |
| DE | 102005058940 | A1 * | 6/2007 | A47L 9/0081 |
| DE | 102015115990 | A1 * | 1/2017 | |
| DE | 102016216292 | A1 * | 3/2018 | |
| EP | 2659822 | A2 * | 11/2013 | A47L 9/0081 |
| EP | 2701286 | A2 * | 2/2014 | H02K 5/20 |
| JP | 2001-165097 | A | 6/2001 | |
| JP | 2008-163852 | A | 7/2008 | |
| JP | 2014219005 | A * | 11/2014 | A47L 5/24 |
| JP | 2019-047669 | A | 3/2019 | |
| KR | 950003350 | Y1 * | 4/1995 | |
| KR | 200144715 | Y1 * | 6/1999 | |
| KR | 20070027137 | A * | 3/2007 | |
| KR | 20080051636 | A * | 6/2008 | |
| KR | 20090055495 | A * | 6/2009 | |
| KR | 20170022920 | A * | 3/2017 | |
| WO | WO-9741631 | A1 * | 11/1997 | A47L 9/0081 |
| WO | WO-03101271 | A1 * | 12/2003 | A47L 9/0081 |
| WO | WO-2014162773 | A1 * | 10/2014 | A47L 5/24 |
| WO | WO-2016144126 | A1 * | 9/2016 | A47L 11/40 |

* cited by examiner

CLEANER

CROSS-REFERENCE TO RELATED APPLICATIONS

This application claims the benefit of priority to Japanese Patent Application No. 2020-112145, filed on Jun. 29, 2020, the entire contents of which are hereby incorporated by reference.

BACKGROUND

1. Technical Field

The present disclosure relates to a cleaner.

2. Description of the Background

A cleaner includes a motor and a fan that rotates with a rotational force from the motor (e.g., Japanese Unexamined Patent Application Publication No. 2019-047669). The fan rotates to suck air together with dust through a suction port of the cleaner. The air sucked through the suction port flows through the internal space of the cleaner before being discharged through exhaust ports.

BRIEF SUMMARY

The cleaner produces noise that may cause discomfort to the user and other persons nearby.

One or more aspects of the present disclosure are directed to a cleaner that reduces noise.

An aspect of the present disclosure provides a cleaner, including:

- a motor assembly including
  - a motor, and
  - a fan rotatable about a rotation axis with a rotational force generated by the motor;
- a cover surrounding the motor assembly;
- a guide configured to guide air from the fan at least partially to an outer surface of the cover; and
- a rib assembly configured to guide the air guided by the guide at least partially in a circumferential direction about the rotation axis along the outer surface of the cover.

The cleaner according to the above aspect of the present disclosure reduces noise.

DETAILED DESCRIPTION

Although one or more embodiments of the present disclosure are described with reference to the drawings, the present disclosure is not limited to the present embodiments. The components in the embodiments described below may be combined as appropriate. One or more components may be eliminated.

In the embodiments, the positional relationships between the components will be described using the directional terms such as front and rear (or forward and backward), right and left (or lateral), and up and down (or vertical). The terms indicate relative positions or directions with respect to the center of a cleaner 1.

Overview of Cleaner

Figure 1:
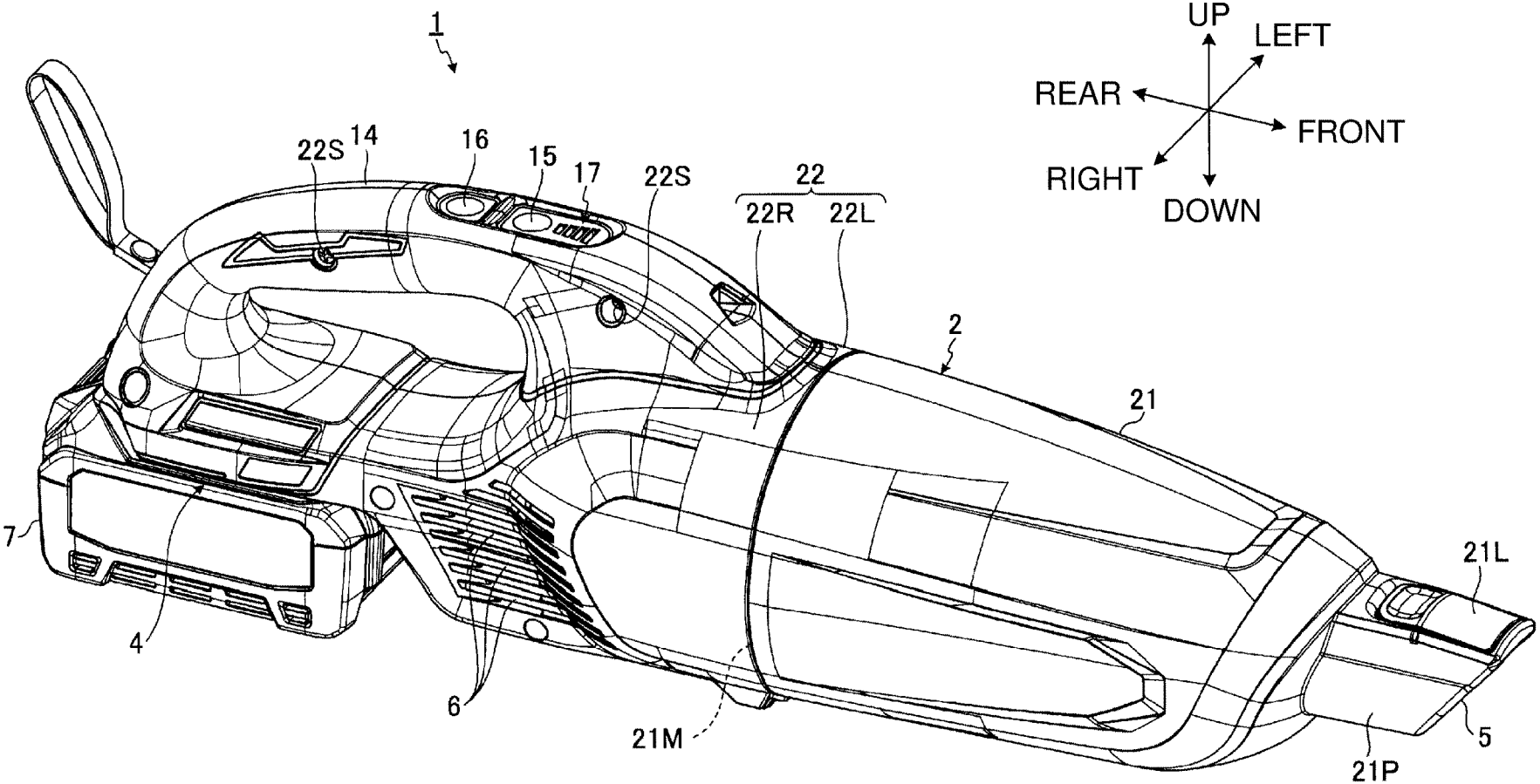
FIG. 1 is a perspective view of a cleaner according to an embodiment.
Figure 2:
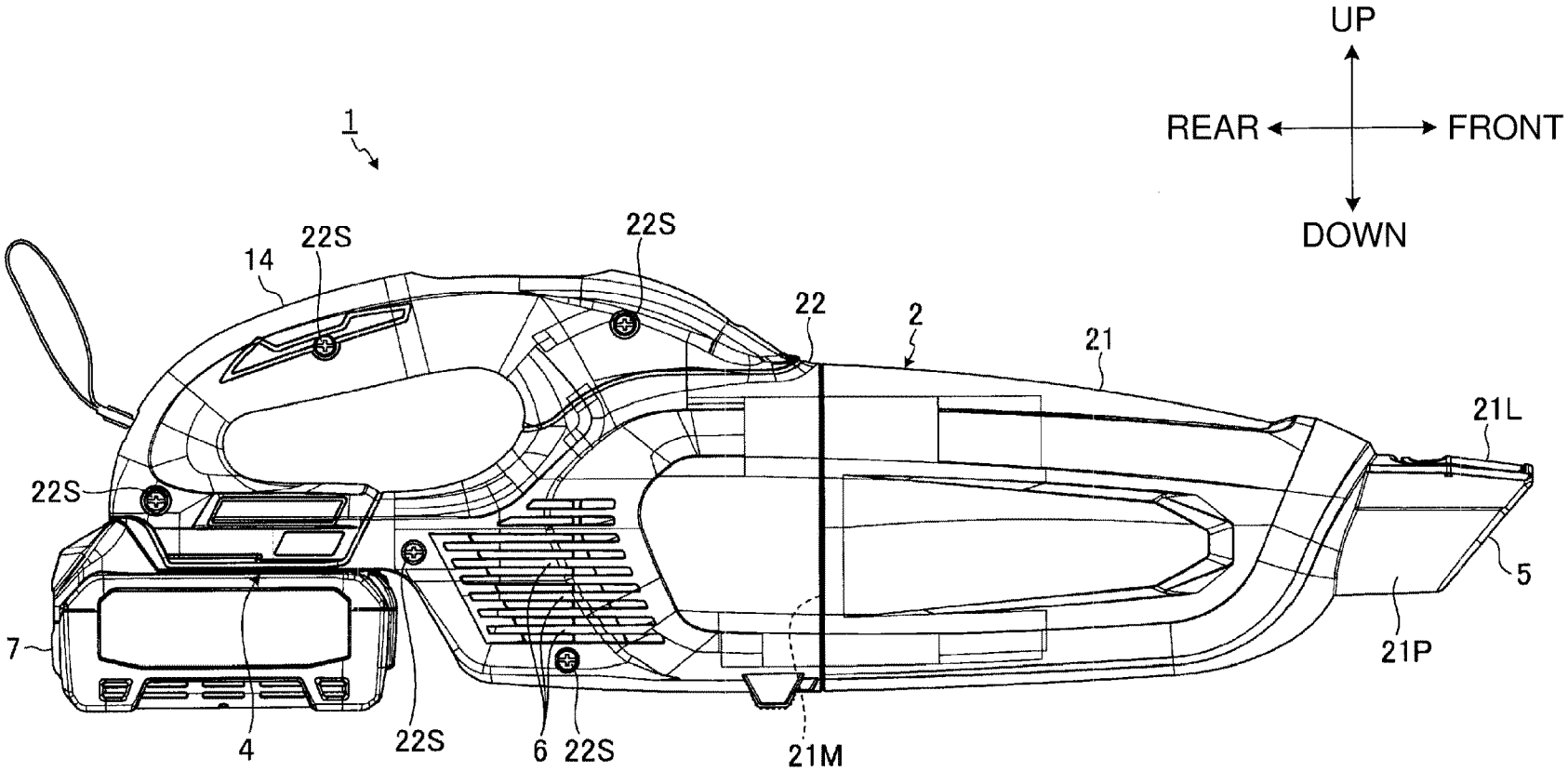
FIG. 2 is a side view of the cleaner according to the embodiment.
Figure 3:
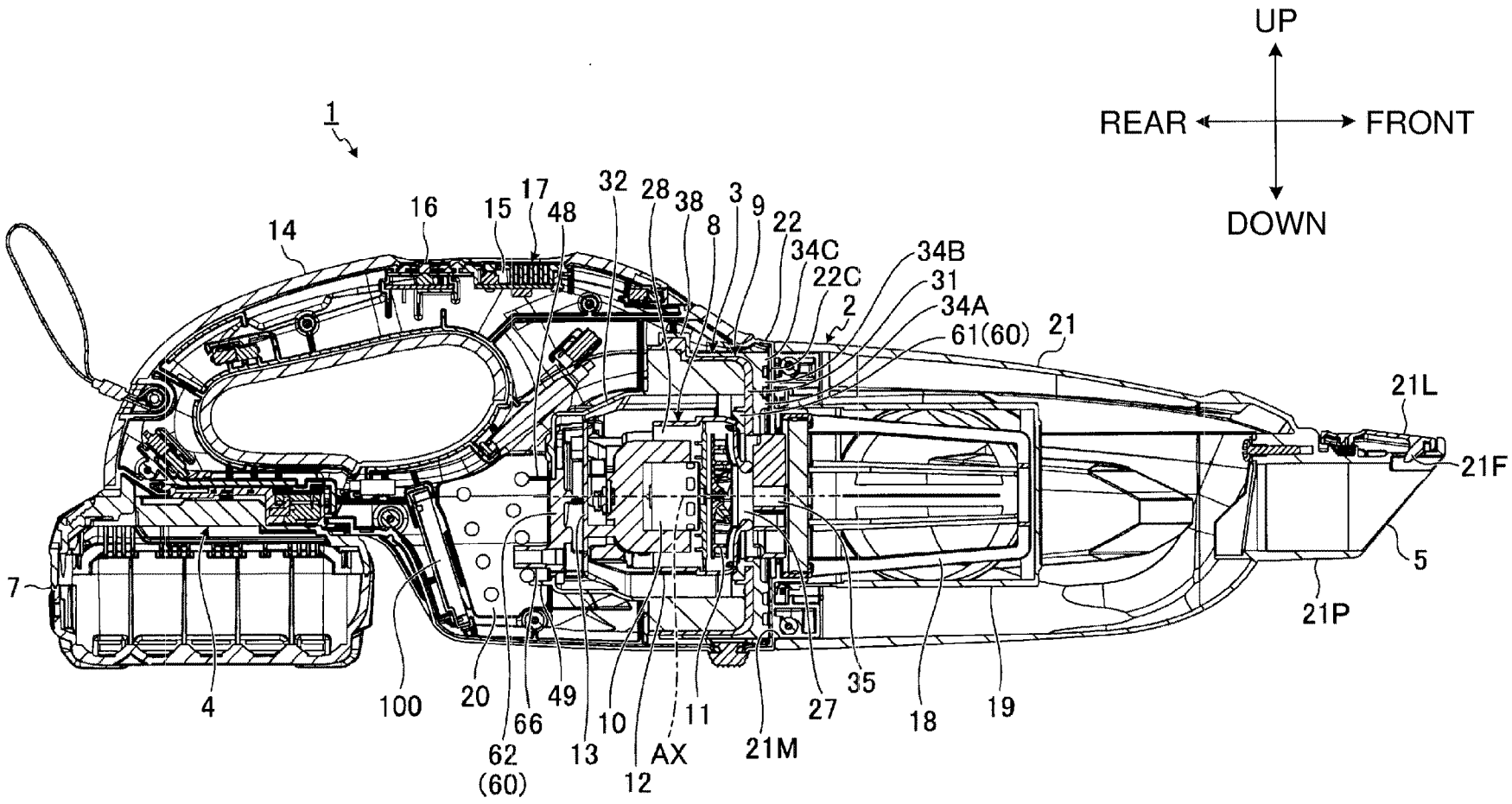
FIG. 3 is a cross-sectional view of the cleaner according to the embodiment.

FIG. 1 is a perspective view of the cleaner 1 according to an embodiment. FIG. 2 is a side view of the cleaner 1 according to the embodiment. FIG. 3 is a cross-sectional view of the cleaner 1 according to the embodiment.

The cleaner 1 includes a housing 2, a drive unit 3, a battery mount 4, and a controller 100.

The housing 2 accommodates the drive unit 3. The housing 2 includes a front housing 21 and a rear housing 22. The front housing 21 has an opening 21M at the rear to receive the front of the rear housing 22. This allows the front housing 21 and the rear housing 22 to be connected together in a detachable manner.

The front housing 21 includes a suction port 5. The front housing 21 includes a connection pipe 21P at the front. The suction port 5 is located at the front end of the connection pipe 21P. The suction port 5 connects the inside and the outside of the front housing 21.

The suction port 5 receives a basal end of a suction pipe (not shown). The suction pipe has a distal end connectable to a suction nozzle (not shown). The connection pipe 21P includes a lock 21L. The lock 21L allows the suction pipe to be fastened to the connection pipe 21P. The suction pipe has a recess. As shown in FIG. 3, the lock 21L includes a hook 21F. The hook 21F is hooked in the recess on the suction pipe to fasten the suction pipe to the connection pipe 21P. The lock 21L is unlocked to release the suction pipe from the connection pipe 21P. The suction pipe is detachable from the connection pipe 21P.

The rear housing 22 has exhaust ports 6. The rear housing 22 includes a left housing 22L and a right housing 22R. The left housing 22L is located on the left of the right housing 22R. The left housing 22L and the right housing 22R are fastened together with multiple screws 22S. The left housing 22L and the right housing 22R each have the exhaust ports 6. The exhaust ports 6 connect the inside and the outside of the rear housing 22.

As shown in FIG. 3, the drive unit 3 is located in the internal space of the rear housing 22. The drive unit 3 includes a motor assembly 8 and a cover 9.

The motor assembly 8 includes a motor 10, a fan 11, a motor case 12, and a control board 13. The motor 10 generates a rotational force for rotating the fan 11. The fan 11 rotates with the rotational force generated by the motor 10. The motor case 12 accommodates the motor 10 and the fan 11. The control board 13 outputs control signals for controlling the motor 10. The control board 13 includes, for example, field-effect transistors (FETs).

The cover 9 surrounds and accommodates the motor assembly 8.

The rear housing 22 includes a handle 14 gripped by a user of the cleaner 1. The handle 14 includes a mode switch button 15, a drive button 16, and a display 17. The user gripping the handle 14 can operate the mode switch button 15 and the drive button 16.

The battery mount 4 is located below the housing 2 at the rear. The battery mount 4 receives a battery 7. The battery 7 is detachable from the battery mount 4.

The battery 7 serves as a power supply. The battery 7 is attached to the battery mount 4 and supplies power to the cleaner 1. The motor 10 runs on power supplied from the battery 7. The controller 100 operates on power supplied from the battery 7. The battery 7 is a general-purpose battery for powering various electrical instruments. The battery 7 is usable for powering power tools or other electrical instruments. The battery 7 is usable for powering cleaners other than the cleaner 1 according to the embodiment. The battery 7 is a rechargeable battery such as a lithium-ion battery. The battery mount 4 has a structure similar to the structure of a battery mount in a power tool.

The user of the cleaner 1 attaches and detaches the battery 7 to and from the battery mount 4. The battery mount 4 includes a guide and a mount terminal. The battery 7 includes a battery terminal. The guide on the battery mount 4 guides the battery 7. The mount terminal on the battery mount 4 is connectable to the battery terminal on the battery 7. The user places the battery 7 from the rear and moves the battery 7 along the guide to attach the battery 7 to the battery mount 4. This electrically connects the battery terminal on the battery 7 and the mount terminal on the battery mount 4. The battery 7 includes a release button. The user of the cleaner 1 operates the release button on the battery 7 to move the battery 7 backward to remove the battery 7 from the battery mount 4.

The controller 100 controls electronic devices in the cleaner 1. The controller 100 controls the motor 10 with the control board 13. The controller 100 controls the drive current to be supplied from the battery 7 to the motor 10. The controller 100 is accommodated in the rear housing 22. The controller 100 includes a board incorporating multiple electronic components. Examples of the electronic components on the board include a processor such as a central processing unit (CPU), a nonvolatile memory such as a read-only memory (ROM) or a storage, a volatile memory such as a random-access memory (RAM), and a resistor.

As shown in FIG. 3, the cleaner 1 includes a holder 18 holding a filter 19. The holder 18 includes multiple linear members. The holder 18 is located in the internal space of the front housing 21. The filter 19 surrounds the holder 18 to collect dust. The holder 18 and the filter 19 are between the suction port 5 and the drive unit 3 in the internal space of the front housing 21.

The rear housing 22 includes sound absorbers 20 in the internal space. The sound absorbers 20 face the exhaust ports 6. The sound absorbers 20 are formed from a porous material with open-cell foam. The sound absorbers 20 absorb sound traveling through air to reduce noise. Noise from the cleaner 1 includes noise resulting from an airflow or rotation of the fan 11.

The cleaner 1 is a handheld cleaner including the handle 14 gripped by the user for cleaning. The motor 10 being stopped starts running in response to the drive button 16 being operated. The running motor 10 rotates the fan 11 to generate a suction force through the suction port 5. The suction force causes air outside the housing 2 to be sucked through the suction port 5 together with dust.

The air sucked through the suction port 5 flows into the internal space of the front housing 21 and flows through the filter 19. The filter 19 collects dust in the air. The air flows through the filter 19 and the drive unit 3 and is then discharged outside the housing 2 through the exhaust ports 6.

The rotational speed of the motor 10 is adjusted in four steps in response to the mode switch button 15 being pushed while the motor 10 is running. In response to a push on the mode switch button 15, the motor 10 switches from a first rotational speed to a second rotational speed. In response to another push on the mode switch button 15, the motor 10 switches from the second rotational speed to a third rotational speed. In response to still another push on the mode switch button 15, the motor 10 switches from the third rotational speed to a fourth rotational speed. In response to still another push on the mode switch button 15, the motor 10 switches back to the first rotational speed.

As the motor 10 changes its rotational speed, the suction force through the suction port 5 changes accordingly. The running motor 10 stops in response to the drive button 16 being operated.

The display 17 includes four light emitters. The light emitters are, for example, light-emitting diodes (LEDs). With the motor 10 running at the first rotational speed, one of the light emitters is on. With the motor 10 running at the second rotational speed, two of the light emitters are on. With the motor 10 running at the third rotational speed, three of the light emitters are on. With the motor 10 running at the fourth rotational speed, the four light emitters are on. With the motor 10 stopped, the four light emitters are off.

Rotation Axis of Fan

The fan 11 is rotatable about a rotation axis AX with the rotational force generated by the motor 10. A direction radial from the rotation axis AX is hereafter referred to as a radial direction or radially for convenience. A direction about the rotation axis AX is referred to as a circumferential direction or circumferentially, or a rotation direction for convenience. A direction parallel to the rotation axis AX is referred to as an axial direction or axially for convenience.

A position nearer the rotation axis AX in the radial direction, or a radial direction toward the rotation axis AX, is referred to as radially inward for convenience. A position farther from the rotation axis AX in the radial direction, or a radial direction away from the rotation axis AX, is referred to as radially outward for convenience. A position in one circumferential direction, or one circumferential direction, is referred to as a first circumferential direction for convenience. A position in the other circumferential direction, or the other circumferential direction, is referred to as a second circumferential direction for convenience. A position in one axial direction, or one axial direction, is referred to as a first axial direction for convenience. A position in the other axial direction, or the other axial direction, is referred to as a second axial direction for convenience.

In the embodiments, the rotation axis AX extends in the front-rear direction. The first axial direction is the rear direction. The second axial direction is the front direction.

Drive Unit

Figure 4:
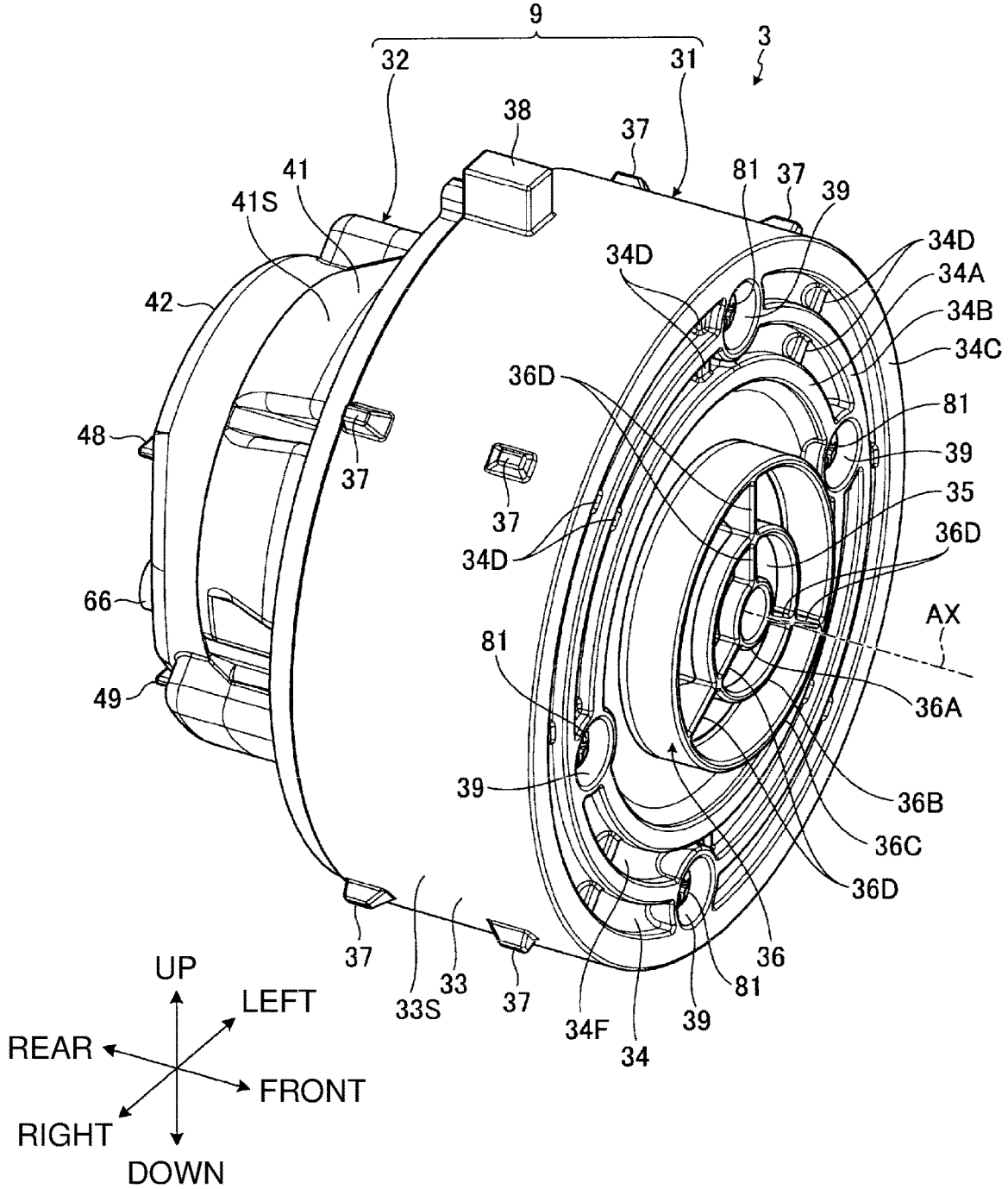
FIG. 4 is a front perspective view of a drive unit in the embodiment.
Figure 5:
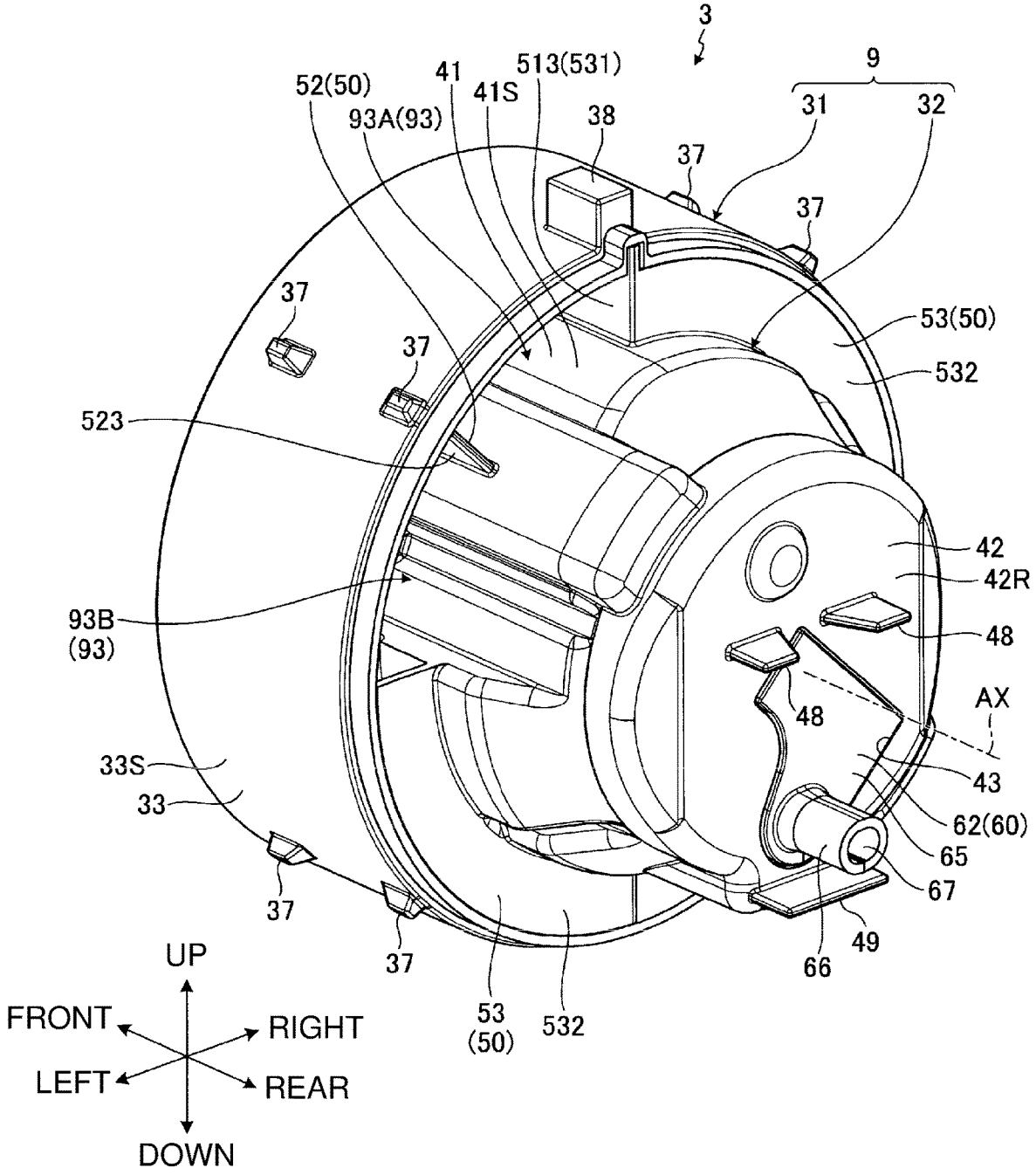
FIG. 5 is a rear perspective view of the drive unit in the embodiment.
Figure 6:
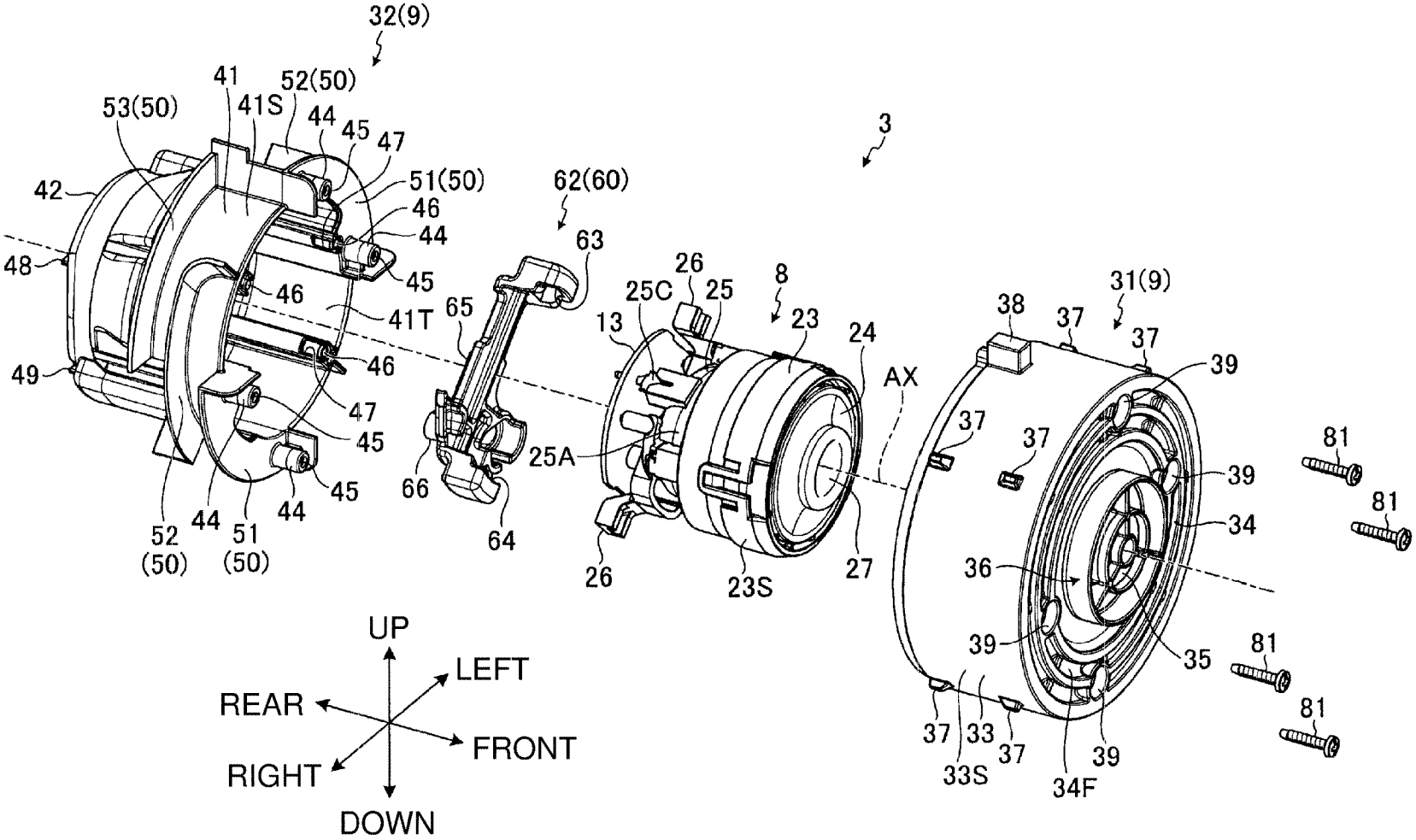
FIG. 6 is an exploded perspective view of the drive unit in the embodiment as viewed from the front.
Figure 7:
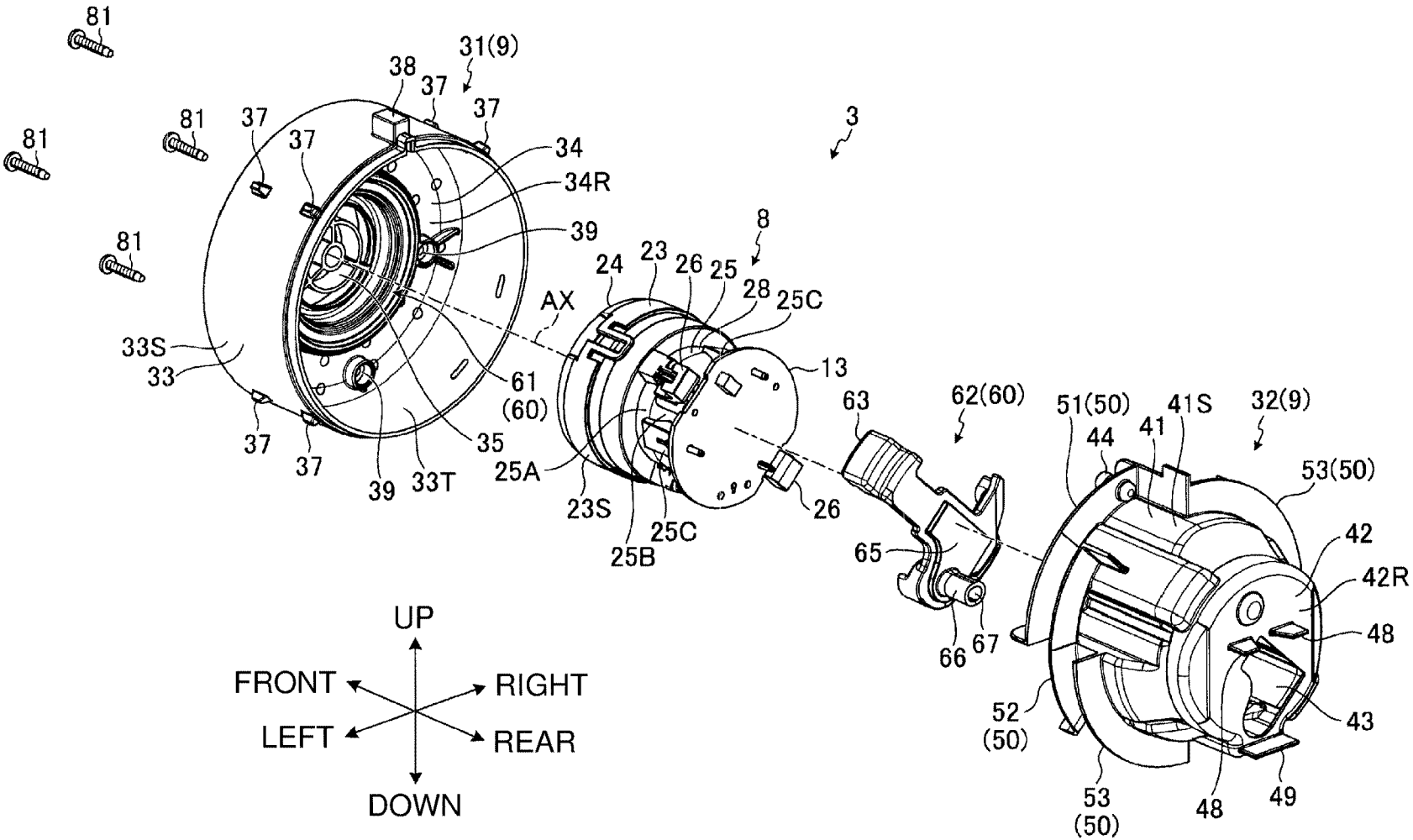
FIG. 7 is an exploded perspective view of the drive unit in the embodiment as viewed from the rear.
Figure 8:
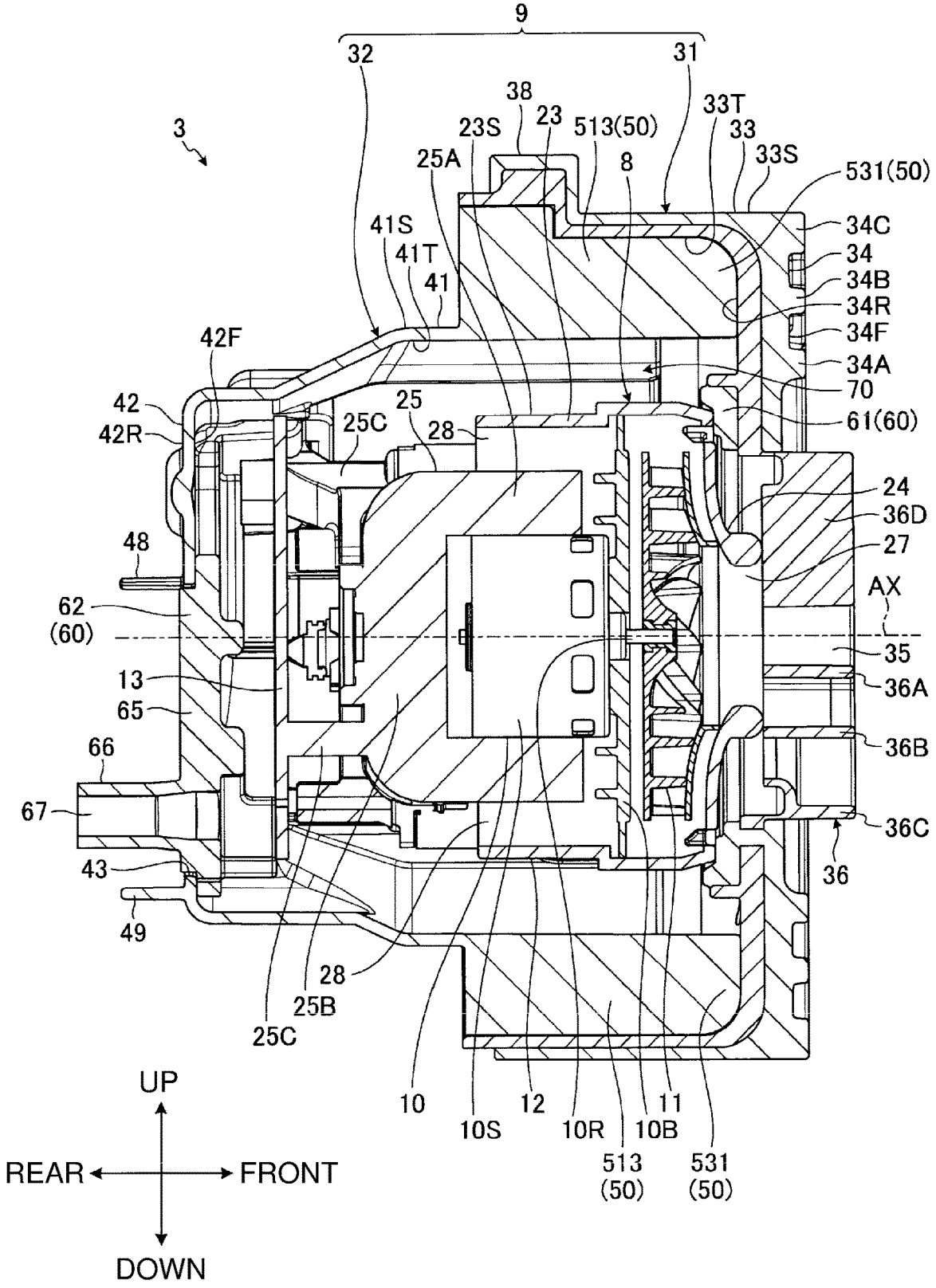
FIG. 8 is a cross-sectional view of the drive unit in the embodiment.

FIG. 4 is a front perspective view of the drive unit 3 in the embodiment. FIG. 5 is a rear perspective view of the drive unit 3 in the embodiment. FIG. 6 is an exploded perspective view of the drive unit 3 in the embodiment as viewed from the front. FIG. 7 is an exploded perspective view of the drive unit 3 in the embodiment as viewed from the rear. FIG. 8 is a cross-sectional view of the drive unit 3 in the embodiment. The drive unit 3 includes the motor assembly 8, the cover 9, a rib assembly 50, a guide 70, and an elastic member 60.

Motor Assembly

As shown in FIGS. 6 to 8, the motor assembly 8 includes the motor 10, the fan 11, the motor case 12, and the control board 13.

The motor 10 generates a rotational force for rotating the fan 11. The motor 10 is an inner-rotor motor. The motor 10 includes a cylindrical stator 10S and a rotor located inside the stator 10S. The rotor is fixed to a rotor shaft 10R. The rotor shaft 10R has its front protruding frontward from the stator 10S. The fan 11 is fixed to the front of the rotor shaft 10R.

The fan 11 is located frontward from the motor 10. The fan 11 is rotatable about the rotation axis AX with the rotational force generated by the motor 10. The fan 11 is a centrifugal fan. The fan 11 rotates to draw air in front of the fan 11 and blows the air radially outward.

The motor case 12 accommodates the motor 10 and the fan 11. The motor case 12 includes a cylinder 23, a fan cover 24, a support 25, and legs 26.

The cylinder 23 is located about the rotation axis AX. The fan cover 24 is located frontward from the fan 11. The fan cover 24 is at the front end of the cylinder 23.

The support 25 supports the motor 10 and the control board 13. The support 25 includes a cylinder 25A, a rear plate 25B, and protrusions 25C. The cylinder 25A surrounds the stator 10S. The rear plate 25B is connected to the rear end of the cylinder 25A. The protrusions 25C protrude rearward from the rear surface of the rear plate 25B. The cylinder 25A fixes the stator 10S. The stator 10S has its front end fixed to a base plate 10B. The base plate 10B is substantially circular. The base plate 10B has a hole at the center for receiving the rotor shaft 10R. The fan 11 is located frontward from the base plate 10B. The base plate 10B has its periphery fixed to the cylinder 23. The stator 10S is fixed to the cylinder 23 with the base plate 10B in between.

The legs 26 are located rearward from the rear plate 25B. Two legs 26, located opposite to each other in the radial direction, are fixed to the support 25. The legs 26 are located radially outward from an outer surface 23S of the cylinder 23.

The motor case 12 includes an inflow port 27 and an outflow port 28. The inflow port 27 is at the front end of the motor case 12. The outflow port 28 is located rearward from the inflow port 27. The inflow port 27 in the embodiment is at the center of the fan cover 24. The outflow port 28 is defined by the rear end of the cylinder 23 and the outer surface of the cylinder 25A. The air from the fan 11 is discharged backward from the motor case 12 through the outflow port 28.

The control board 13 outputs control signals for controlling the motor 10. The control board 13 is located rearward from the rear plate 25B. The control board 13 faces the rear plate 25B in the support 25. The control board 13 is supported on the protrusions 25C on the support 25. The control board 13 is between the two legs 26.

Cover

The cover 9 surrounds and accommodates the motor assembly 8. As shown in FIG. 3, the cover 9 is fixed to the housing 2.

The cover 9 includes a first cover 31 and a second cover 32. The second cover 32 is at least partially located rearward from the first cover 31. The second cover 32 is connected to the first cover 31 in a detachable manner. The first cover 31 and the second cover 32 form the internal space of the cover 9 to accommodate the motor assembly 8.

Figure 9:
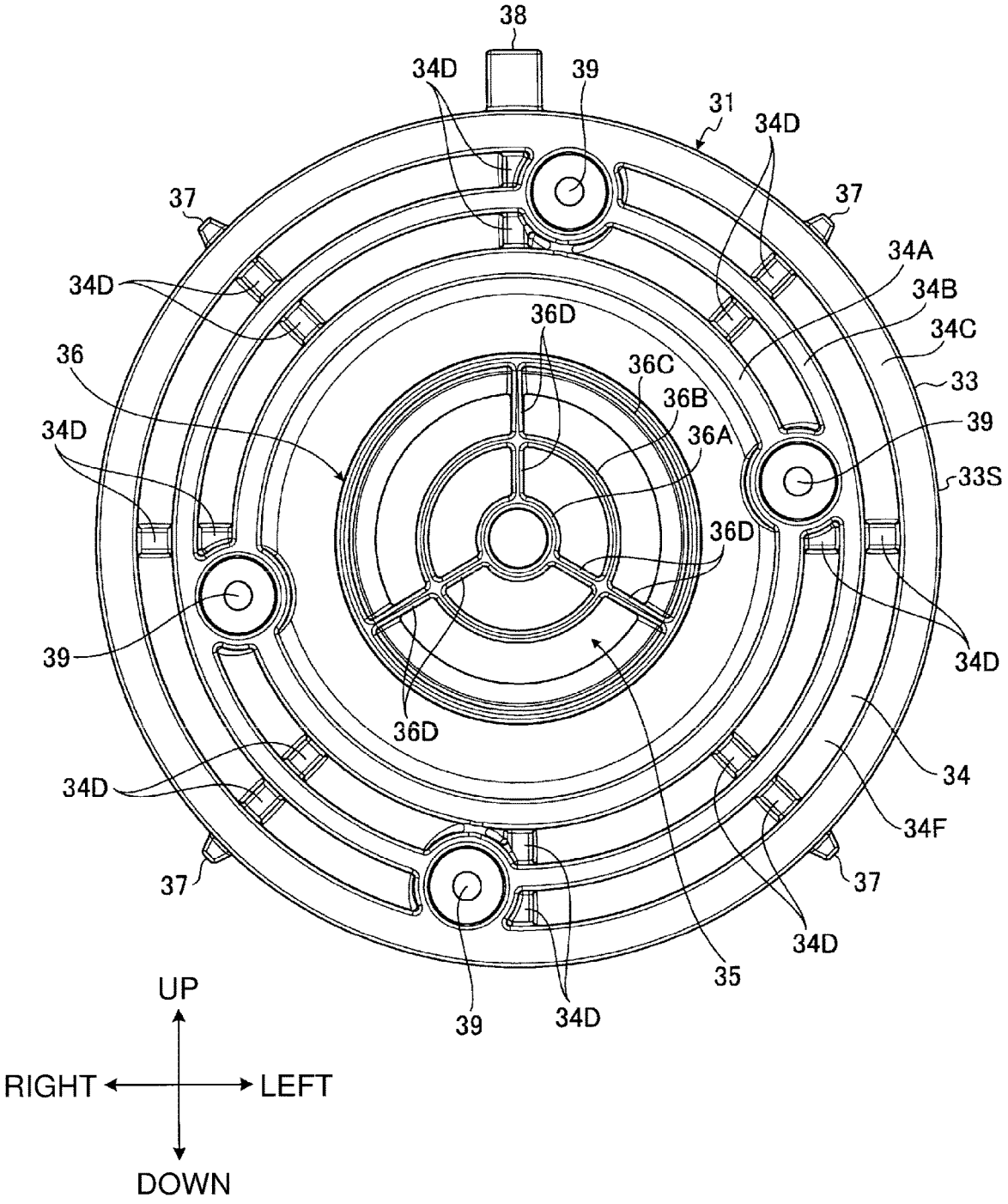
FIG. 9 is a front view of a first cover in the embodiment.
Figure 10:
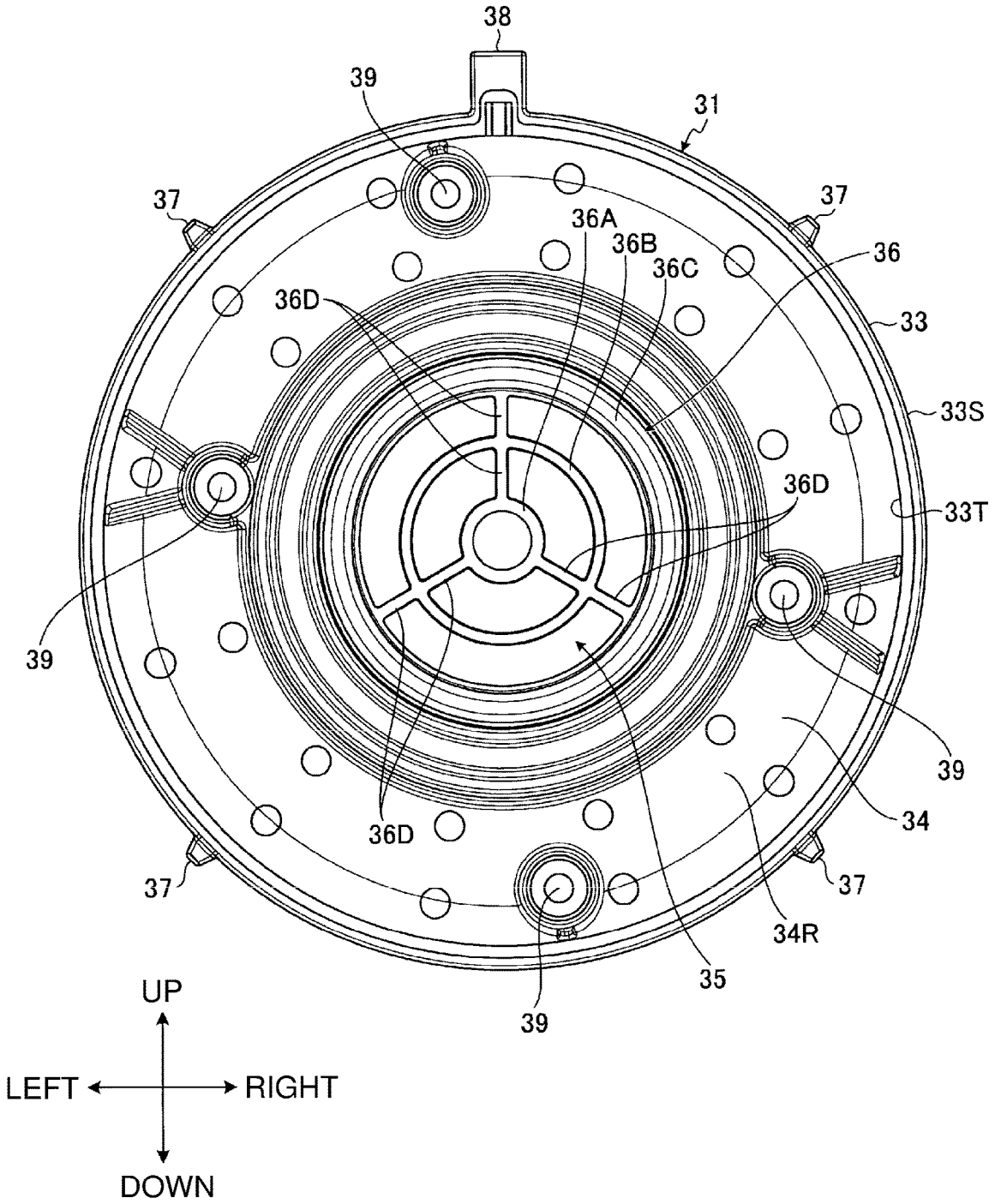
FIG. 10 is a rear view of the first cover in the embodiment.

FIG. 9 is a front view of the first cover 31 in the embodiment. FIG. 10 is a rear view of the first cover 31 in the embodiment. As shown in FIGS. 4 to 10, the first cover 31 includes a first cylinder 33, a front plate 34, a suction port 35, a flow straightener 36, first protrusions 37, and a second protrusion 38.

The first cylinder 33 is substantially cylindrical. The first cylinder 33 is located about the rotation axis AX. The first cylinder 33 has an outer surface 33S and an inner surface 33T. The outer surface 33S and the inner surface 33T are each located about the rotation axis AX. The outer surface 33S faces radially outward. The inner surface 33T faces radially inward.

The front plate 34 is connected to the front end of the first cylinder 33. The front plate 34 has a substantially circular profile. The front plate 34 has a front surface 34F and a rear surface 34R. The front surface 34F faces frontward. The rear surface 34R faces rearward.

The suction port 35 is at the center of the front plate 34. The suction port 35 has a through-hole connecting the front surface 34F and the rear surface 34R of the front plate 34.

The front plate 34 has the front surface 34F including a first ring 34A, a second ring 34B, a third ring 34C, and multiple ribs 34D. The first to third rings 34A to 34C and the ribs 34D protrude frontward from the front surface 34F. The first ring 34A surrounds the suction port 35. The second ring 34B surrounds the first ring 34A. The third ring 34C surrounds the second ring 34B. The ribs 34D are located at intervals in the circumferential direction. The ribs 34D extend in the radial direction. The ribs 34D are connected to each of the first to third rings 34A to 34C. The first to third rings 34A to 34C have the front ends located frontward from the front ends of the ribs 34D.

The flow straightener 36 is inside the suction port 35. The flow straightener 36 guides air to be sucked into the suction port 35. The flow straightener 36 includes a fourth ring 36A, a fifth ring 36B, a sixth ring 36C, and multiple ribs 36D. The fourth to sixth rings 36A to 36C and the ribs 36D have the front ends located frontward from the front surface 34F. The fourth ring 36A is at the center of the suction port 35. The fifth ring 36B surrounds the fourth ring 36A. The sixth ring 36C surrounds the fifth ring 36B. The ribs 36D are located at intervals in the circumferential direction. The ribs 36D extend in the radial direction. The ribs 36D are connected to each of the fourth to sixth rings 36A to 36C. The sixth ring 36C defines the profile of the suction port 35. The sixth ring 36C is fixed to the front plate 34. The fourth ring 36A and the fifth ring 36B are fixed to the sixth ring 36C with the ribs 36D.

The first protrusions 37 are located on the outer surface 33S of the first cylinder 33. The first protrusions 37 protrude radially outward from the outer surface 33S. Four first protrusions 37 are located circumferentially at intervals. Two first protrusions 37 are arranged in the axial direction. In other words, eight first protrusions 37 are located on the outer surface 33S.

The second protrusion 38 is located on the outer surface 33S of the first cylinder 33. The second protrusion 38 protrudes radially outward from the outer surface 33S.

The front plate 34 has multiple (four in the embodiment) screw openings 39.

The first cylinder 33, the front plate 34, the flow straightener 36, the first protrusions 37, and the second protrusion 38 are integral with one another. The first cover 31 is formed by insert molding. The first cover 31 includes a base formed from a synthetic resin. The synthetic resin is, for example, polypropylene. The base is covered with an elastomer. The elastomer is, for example, synthetic rubber.

The outer surface 33S, the first to third rings 34A to 34C, the ribs 34D, the first protrusions 37, and the second protrusion 38 in the embodiment are formed from an elastomer. The inner surface 33T and the flow straightener 36 are formed from a synthetic resin.

As shown in FIG. 3, the rear housing 22 includes a ring 22C located frontward from the cover 9. The ring 22C is fixed to the inner surface of the rear housing 22. The ring 22C has the rear surface in contact with the front surfaces of the first to third rings 34A to 34C. Thus, the cover 9 and the housing 2 are positioned relative to each other.

The first protrusions 37 are in contact with the inner surface of the rear housing 22. Thus, the cover 9 and the housing 2 are positioned relative to each other.

The second protrusion 38 is in contact with the inner surface of the rear housing 22. The cover 9 and the housing 2 are positioned relative to each other with the second protrusion 38 in contact with at least a part of the inner surface of the rear housing 22.

The first to third rings 34A to 34C, the first protrusions 37, and the second protrusion 38 in contact with the rear housing 22 are elastically deformable. This reduces transmission of vibrations from the drive unit 3 to the housing 2.

As shown in FIGS. 4 to 8, the second cover 32 includes a second cylinder 41, a rear plate 42, an opening 43, bosses 44 with screw holes 45, supports 47 supporting pins 46, third protrusions 48, and a fourth protrusion 49.

The second cylinder 41 is substantially cylindrical. The second cylinder 41 is located about the rotation axis AX. The second cylinder 41 has an outer surface 41S and an inner surface 41T. The outer surface 41S and the inner surface 41T are each located about the rotation axis AX. The outer surface 41S faces radially outward. The inner surface 41T faces radially inward. The second cylinder 41 in the embodiment has a rear portion with its inside diameter decreasing toward the rear end.

The rear plate 42 is connected to the rear end of the second cylinder 41. The rear plate 42 has a substantially circular profile. The rear plate 42 has a front surface 42F and a rear surface 42R. The front surface 42F faces frontward. The rear surface 42R faces rearward.

The opening 43 is in the rear plate 42. The opening 43 has a through-hole connecting the front surface 42F and the rear surface 42R of the rear plate 42.

The second cover 32 includes multiple (four in the embodiment) bosses 44 at the front. The bosses 44 each have the screw hole 45.

The supports 47 support the pins 46. The pins 46 are formed from rubber. The supports 47 define recesses on the inner surface 41T of the second cylinder 41. Four supports 47 are located at intervals in the circumferential direction. The four supports 47 each support a corresponding pin 46. The four pins 46 are in contact with the outer surface 23S of the cylinder 23 in the motor case 12. The four pins 46 allow the second cover 32 to be positioned relative to the motor case 12.

Two third protrusions 48 protrude rearward from the rear surface 42R of the rear plate 42 in the upper portion. The two third protrusions 48 align in the lateral direction. As shown in FIG. 3, the third protrusions 48 are in contact with the sound absorbers 20. The left third protrusion 48 supports the sound absorber 20 at the exhaust ports 6 in the left housing 22L. The right third protrusion 48 supports the sound absorber 20 at the exhaust ports 6 in the right housing 22R.

The fourth protrusion 49 protrudes rearward from the rear surface 42R of the rear plate 42 in the lower portion. As shown in FIG. 3, the fourth protrusion 49 is in contact with the sound absorbers 20. The fourth protrusion 49 supports the sound absorbers 20 facing the exhaust ports 6 in the rear housing 22.

Rib Assembly

The rib assembly 50 is fixed to the outer surface 41S of the second cylinder 41. The rib assembly 50 protrudes radially outward from the outer surface 41S of the second cylinder 41. The rib assembly 50 in the embodiment includes first rib assemblies 51, second rib assemblies 52, and third rib assemblies 53. As shown in FIGS. 6 and 7, the rib assembly 50 in the embodiment includes two first rib assemblies 51, two second rib assemblies 52, and two third rib assemblies 53. The two first rib assemblies 51 are located opposite to each other in the radial direction. The two second rib assemblies 52 are located opposite to each other in the radial direction. The two third rib assemblies 53 are located opposite to each other in the radial direction. One first rib assembly 51 includes the first and second bosses 44. The other first rib assembly 51 includes the third and fourth bosses 44. The bosses 44 protrude frontward from the first rib assemblies 51.

The second cylinder 41, the rear plate 42, the bosses 44, the supports 47, the third protrusions 48, the fourth protrusion 49, and the rib assembly 50 in the embodiment are integral with one another. The second cover 32 is formed from a synthetic resin. The synthetic resin used for the second cover 32 is, for example, acrylonitrile butadiene styrene (ABS).

Guide

As shown in FIG. 8, the drive unit 3 includes the guide 70. The guide 70 guides air from the fan 11 at least partially to the outer surface of the second cover 32. The second cover 32 in the embodiment has the outer surface including the outer surface 41S of the second cylinder 41. The guide 70 guides air from the fan 11 at least partially to the outer surface 41S of the second cylinder 41.

The air from the fan 11 is discharged backward from the motor case 12 through the outflow port 28. The air discharged backward through the outflow port 28 flows forward between the outer surface of the motor case 12 and the inner surface 41T of the second cylinder 41. The motor case 12 in the embodiment has the outer surface including the outer surface 23S of the cylinder 23.

The air flows forward between the outer surface of the motor case 12 and the inner surface 41T of the second cylinder 41, and then hits the rear surface 34R of the front plate 34 in the first cover 31. The air then flows onto and along the outer surface 41S of the second cylinder 41 from its front end. The guide 70 in the embodiment includes the outer surface of the motor case 12 and the inner surface 41T of the second cylinder 41 facing the outer surface of the motor case 12. The guide 70 also includes the rear surface 34R of the front plate 34 in the first cover 31.

Elastic Member

The drive unit 3 includes the elastic member 60. The elastic member 60 is between the cover 9 and at least a part of the motor case 12. The elastic member 60 reduces transmission of vibrations from the motor 10 or the fan 11 to the cover 9.

The elastic member 60 in the embodiment includes a first elastic member 61 and a second elastic member 62. The first elastic member 61 is at least partially located frontward from the motor case 12. The second elastic member 62 is at least partially located rearward from the motor case 12.

The first elastic member 61 reduces transmission of vibrations from the motor 10 or the fan 11 to the first cover 31. The first elastic member 61 is between the surface of the fan cover 24 in the motor case 12 and the rear surface 34R of the front plate 34 in the first cover 31. The rear surface 34R of the front plate 34 in the first cover 31 is a facing surface facing at least a part of the surface of the fan cover 24 in the motor case 12. The front plate 34 in the first cover 31 includes the suction port 35 located frontward from the fan cover 24. The first elastic member 61 is annular and surrounds the suction port 35. The first elastic member 61 is connected to the rear surface 34R of the front plate 34.

The first elastic member 61 is molded integrally with the first cover 31. The first elastic member 61 may be a part of the first cover 31. The first cover 31 may be formed by insert molding as described above. In this case, the first elastic member 61 may be formed from an elastomer that covers the base of the first cover 31.

The second elastic member 62 reduces transmission of vibrations from the motor 10 or the fan 11 to the second cover 32. The second elastic member 62 is between the motor case 12 and the rear plate 42 in the second cover 32. The second cover 32 has the opening 43 located rearward from the motor case 12. The second elastic member 62 is connected to at least a part of the motor case 12 with the second elastic member 62 blocking the opening 43. The second elastic member 62 in the embodiment is connected to the legs 26 on the motor case 12.

The second elastic member 62 includes a first connector 63, a second connector 64, a blocker 65, and a pipe 66. The first connector 63 is fixed to one leg 26. The second connector 64 is fixed to the other leg 26. The blocker 65 is between the first connector 63 and the second connector 64. The blocker 65 is inside the opening 43. The pipe 66 protrudes rearward from the rear surface of the blocker 65. The pipe 66 has a support hole 67.

Assembling Drive Unit

Figure 11:
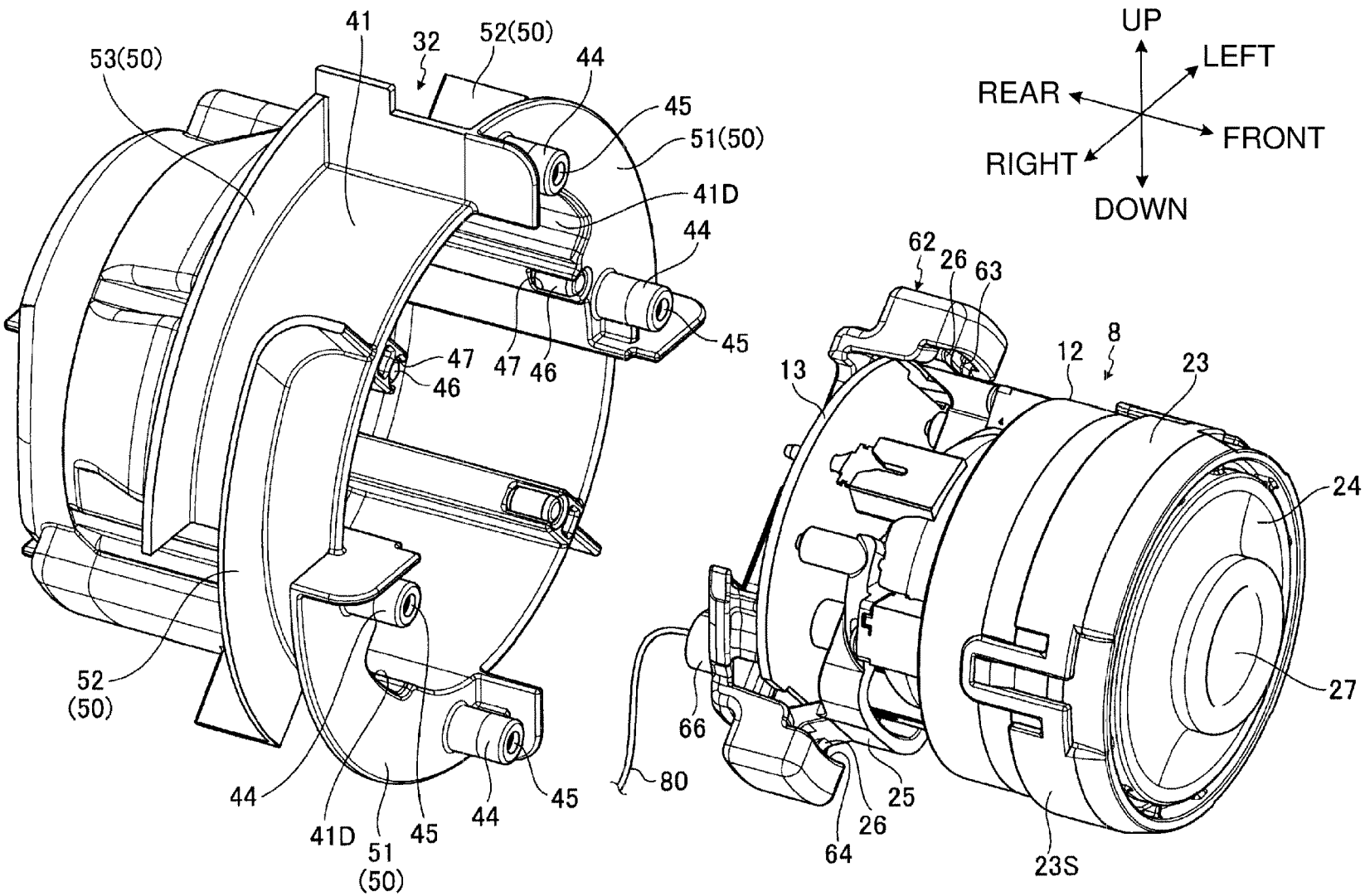
FIG. 11 is a front perspective view of a motor assembly, a second elastic member, and a second cover, describing assembling of the drive unit in the embodiment.
Figure 12:
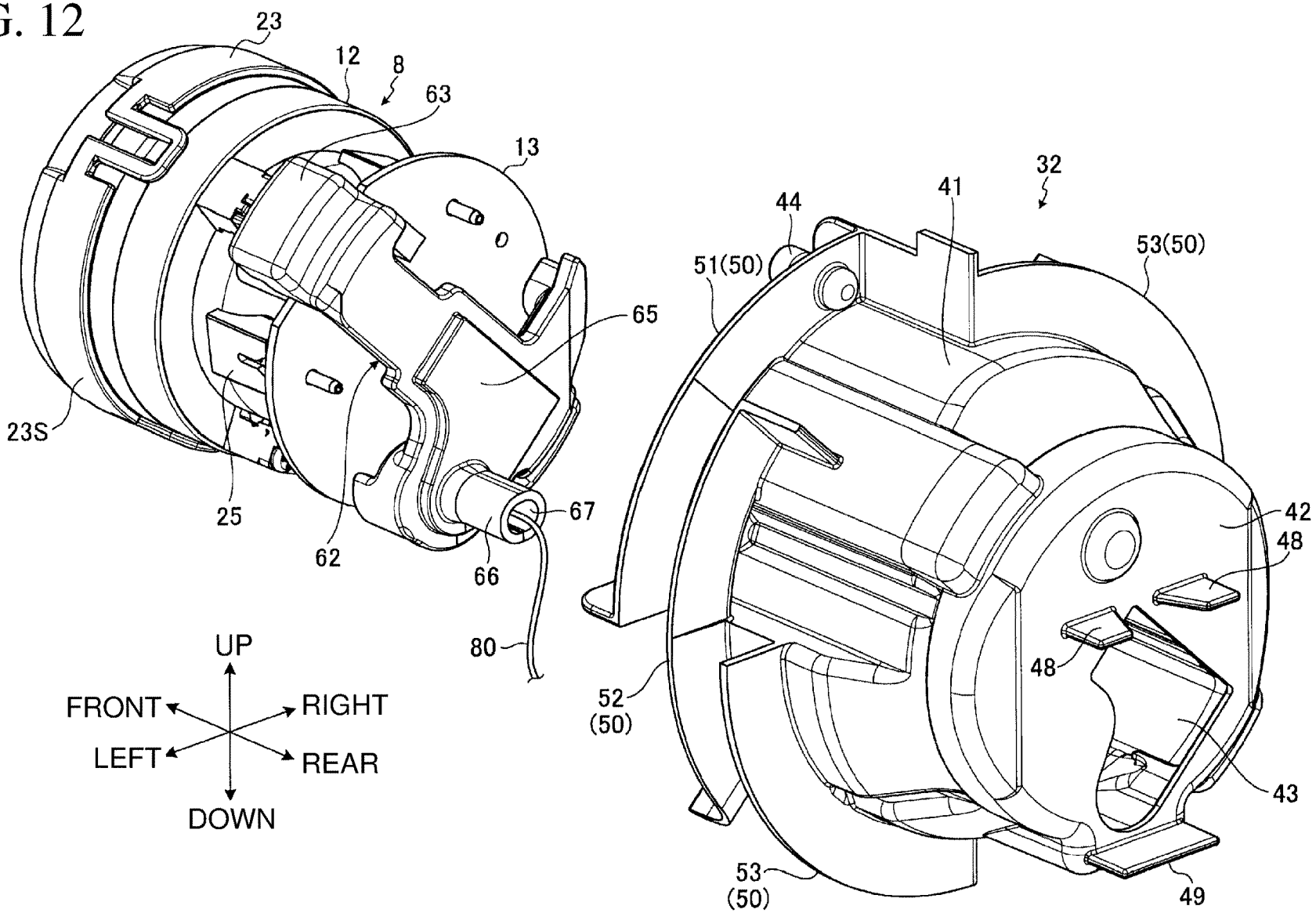
FIG. 12 is a rear perspective view of the motor assembly, the second elastic member, and the second cover, describing assembling of the drive unit in the embodiment.

FIG. 11 is a front perspective view of the motor assembly 8, the second elastic member 62, and the second cover 32, describing assembling of the drive unit 3 in the embodiment. FIG. 12 is a rear perspective view of the motor assembly 8, the second elastic member 62, and the second cover 32, describing assembling of the drive unit 3 in the embodiment.

As shown in FIGS. 11 and 12, the control board 13 is connected to a cable 80. The cable 80 connects the control board 13 to the controller 100. The cable 80 is used to, for example, supply power from the battery 7 to the motor 10 and provide control signals to the control board 13. The cable 80 is received in the support hole 67 in the second elastic member 62.

As shown in FIGS. 11 and 12, assembling the drive unit 3 involves connecting the second elastic member 62 to the legs 26 on the motor case 12 with the cable 80 received in the support hole 67. The second elastic member 62 has the first connector 63 hooked on one leg 26, and has the second connector 64 hooked on the other leg 26. The second elastic member 62 is thus connected to the motor case 12.

The two legs 26 protrude radially outward from the outer surface 23S of the cylinder 23. The second elastic member 62, which has a larger radial dimension than the cylinder 23, can be appropriately connected to the motor case 12 with the legs 26.

The second elastic member 62 is connected to the motor case 12 to have the blocker 65 facing the control board 13. The first connector 63 and the second connector 64 are located radially outward from the control board 13.

The motor case 12 and the second elastic member 62 connected together are then connected to the second cover 32. The motor case 12 and the second elastic member 62 are placed inside the second cover 32 through the front opening in the second cover 32. The second cylinder 41 in the embodiment has the inner surface 41T with two recesses 41D recessed radially outward. The recesses 41D extend in the axial direction. The recesses 41D have the front ends continuous with the first rib assemblies 51. The first connector 63 is axially movable inside one recess 41D. The second connector 64 is axially movable inside the other recess 41D.

The motor case 12 and the second elastic member 62 are placed inside the second cover 32 to have the blocker 65 blocking the opening 43 in the second cover 32. The pins 46 come in contact with the outer surface 23S of the cylinder 23 in the motor case 12 placed inside the second cover 32. The motor case 12 is positioned with the pins 46. The cable 80 at least partially extends from the rear end of the support hole 67.

The second cover 32 is connected to the motor assembly 8 and the second elastic member 62, and is then connected to the first cover 31. The first cylinder 33 in the first cover 31 has an inside diameter larger than the outside diameter of the second cylinder 41 in the second cover 32. The first cover 31 and the second cover 32 are connected together to have the inner surface 33T of the first cylinder 33 and at least a part of the outer surface 41S of the second cylinder 41 facing each other. The second cylinder 41 includes the rib assembly 50 on the outer surface 41S. The first cover 31 and the second cover 32 are connected together to have the rib assembly 50 located inside the first cylinder 33. The rib assembly 50 is between the inner surface 33T of the first cylinder 33 and the outer surface 41S of the second cylinder 41.

The first cover 31 has the screw openings 39. The second cover 32 has the screw holes 45. As shown in FIGS. 4, 6, and 7, the first cover 31 and the second cover 32 are fastened together with four screws 81. The screws 81 are placed into the screw openings 39 from the front of the first cover 31.

The screws 81 are then placed into and received in the screw holes 45. The screws 81 thus fasten the first cover 31 and the second cover 32 together.

As shown in FIG. 8, with the first cover 31 and the second cover 32 connected together, the fan cover 24 at the front end of the motor case 12 is in contact with the first elastic member 61 supported on the first cover 31. The motor assembly 8 is connected to the first cover 31 with the first elastic member 61 in between. The motor assembly 8 is connected to the second cover 32 with the second elastic member 62 in between. The motor assembly 8 is supported on the cover 9 with the first elastic member 61 and the second elastic member 62 in between. The motor assembly 8 is supported on the cover 9 with the motor assembly 8 being held between the first elastic member 61 and the second elastic member 62 in the axial direction.

Ribs and Flow Paths

Figure 13:
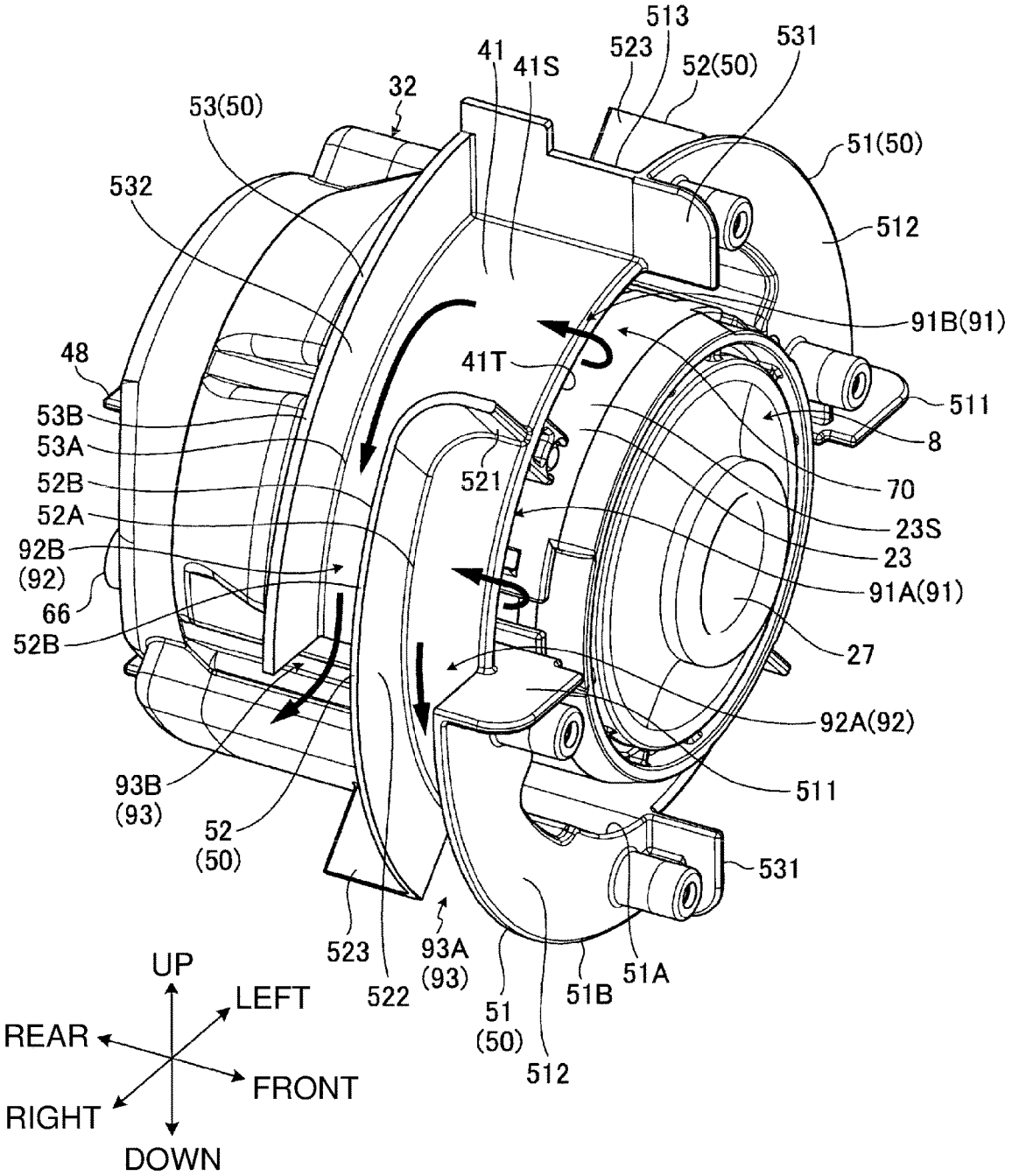
FIG. 13 is a perspective view of the second cover holding the motor assembly in the embodiment as viewed from the right front.
Figure 14:
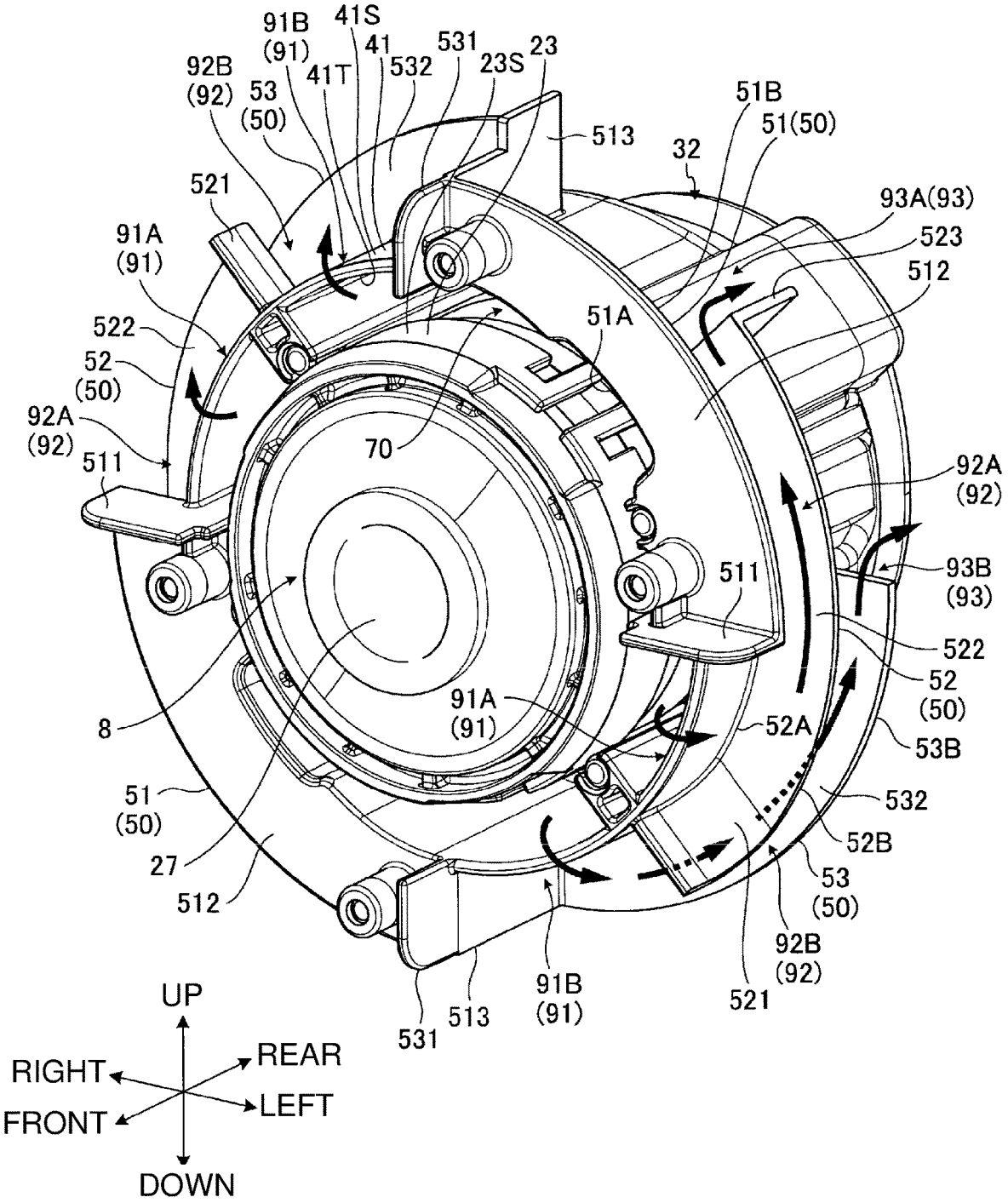
FIG. 14 is a perspective view of the second cover holding the motor assembly in the embodiment as viewed from the left front.
Figure 15:
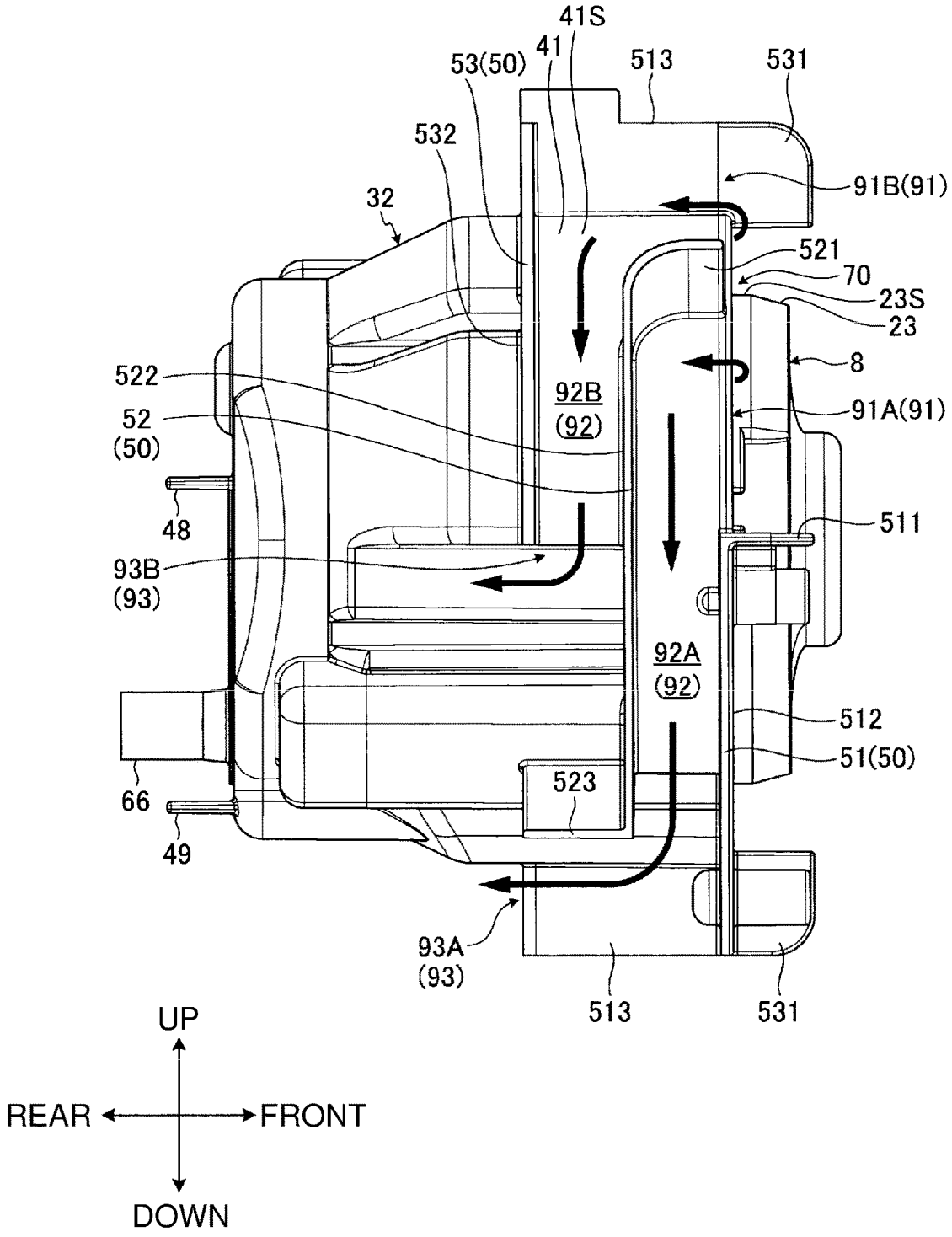
FIG. 15 is a right view of the second cover holding the motor assembly in the embodiment.
Figure 16:
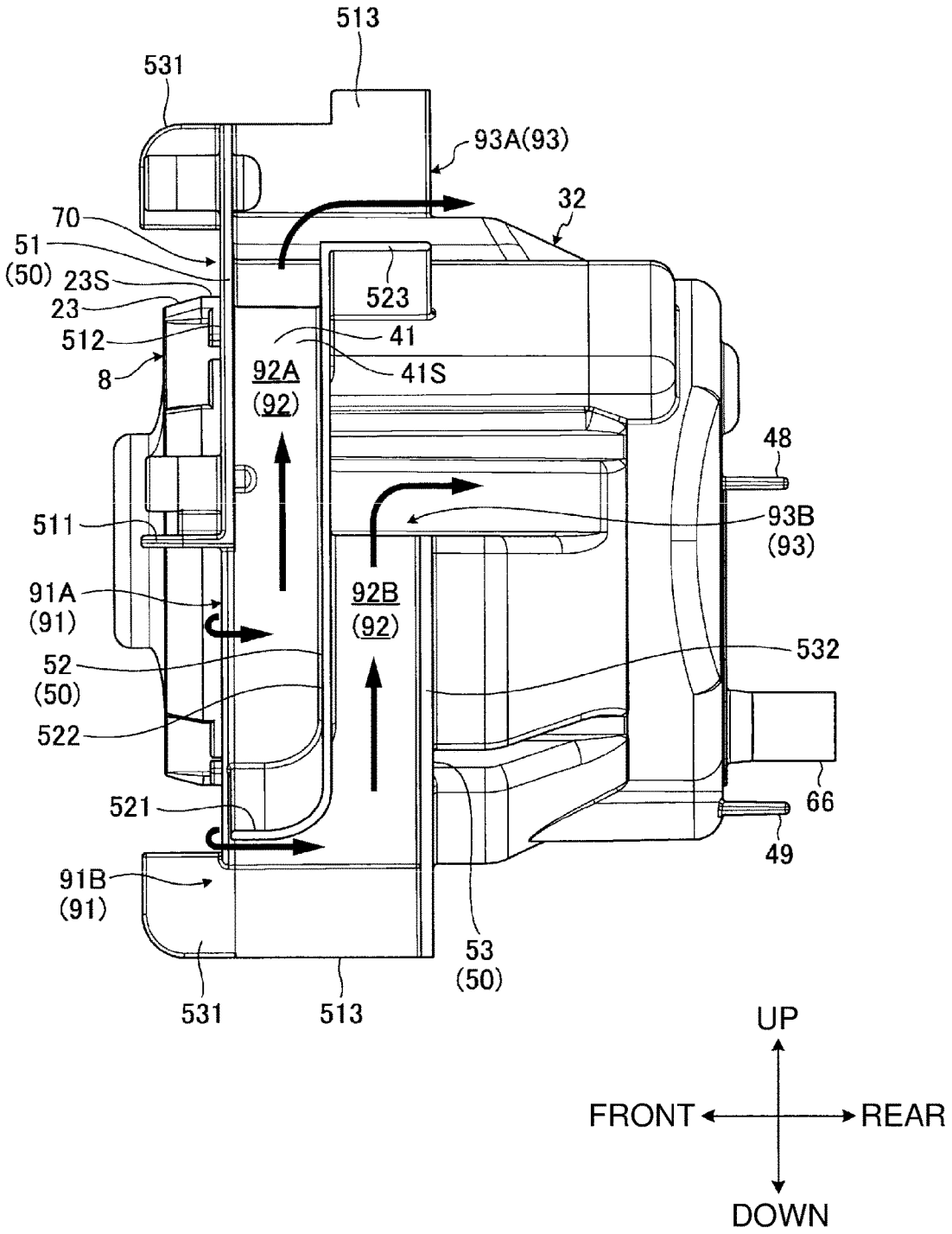
FIG. 16 is a left view of the second cover holding the motor assembly in the embodiment.
Figure 17:
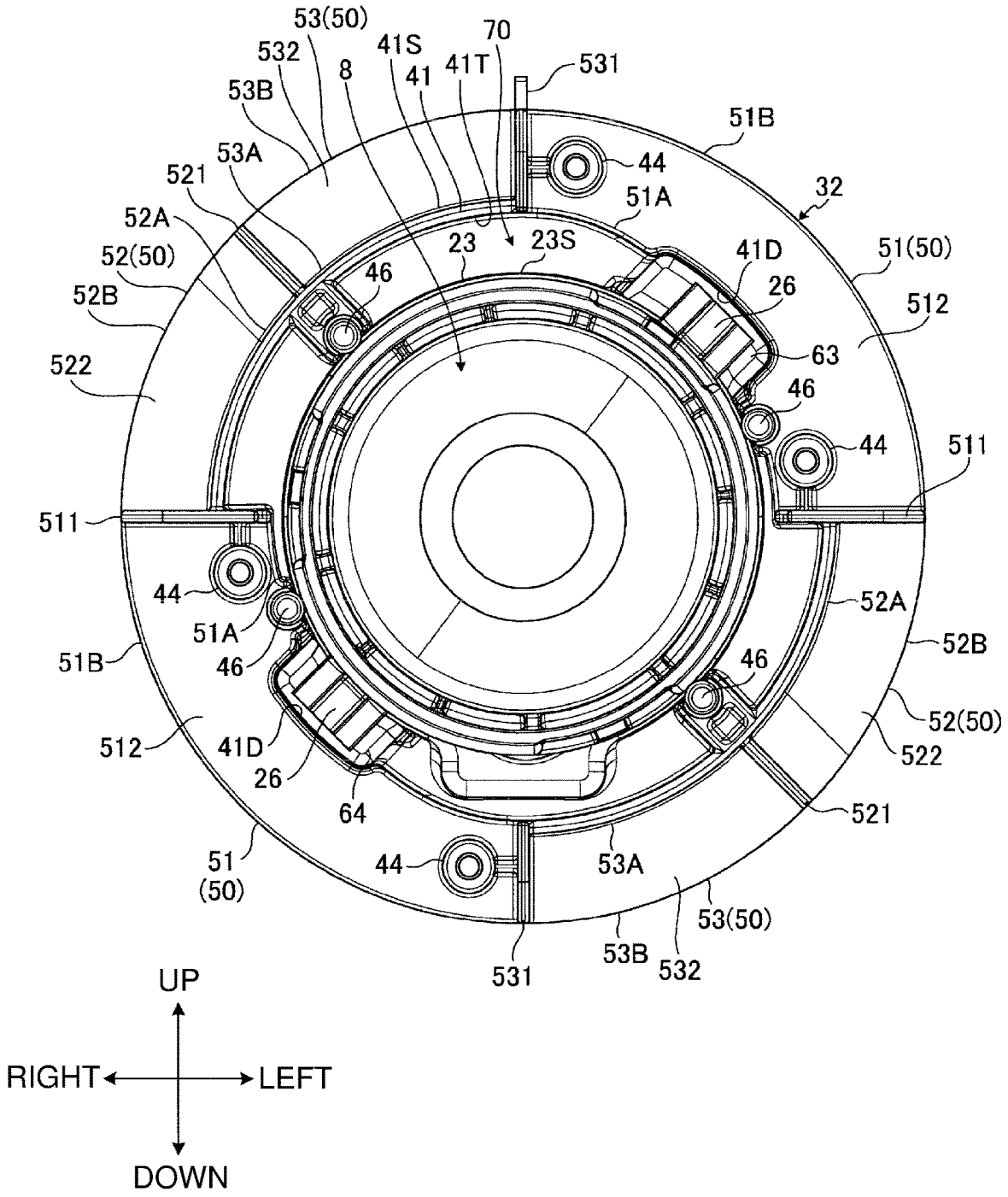
FIG. 17 is a front view of the second cover holding the motor assembly in the embodiment.
Figure 18:
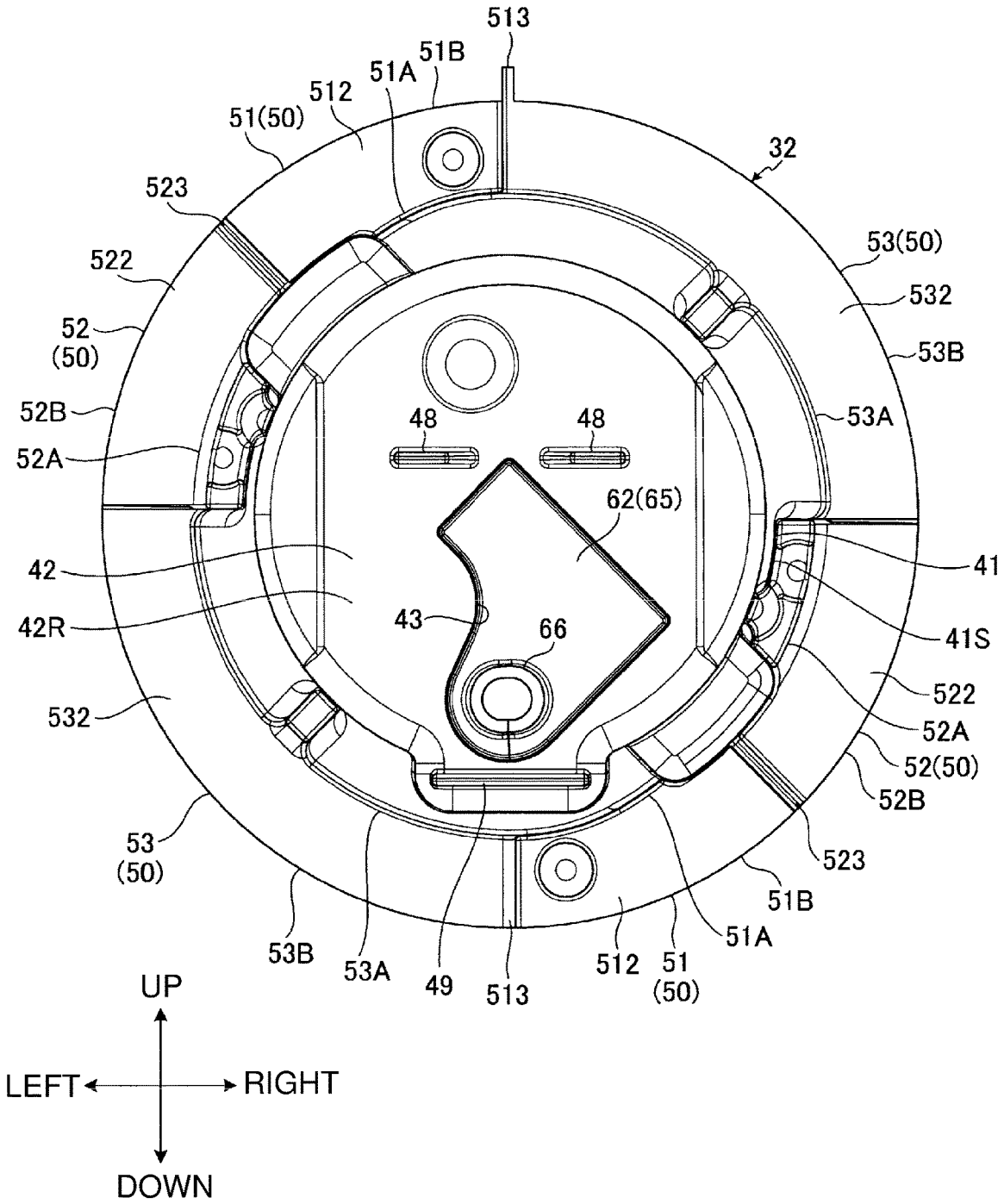
FIG. 18 is a rear view of the second cover holding the motor assembly in the embodiment.

FIG. 13 is a perspective view of the second cover 32 holding the motor assembly 8 in the embodiment as viewed from the right front. FIG. 14 is a perspective view of the second cover 32 holding the motor assembly 8 in the embodiment as viewed from the left front. FIG. 15 is a right view of the second cover 32 holding the motor assembly 8 in the embodiment. FIG. 16 is a left view of the second cover 32 holding the motor assembly 8 in the embodiment. FIG. 17 is a front view of the second cover 32 holding the motor assembly 8 in the embodiment. FIG. 18 is a rear view of the second cover 32 holding the motor assembly 8 in the embodiment.

As shown in FIGS. 13 to 18, the second cover 32 includes the rib assembly 50. The rib assembly 50 is fixed to the outer surface 41S of the second cylinder 41. The rib assembly 50 guides air that has been guided by the guide 70 to the outer surface of the second cover 32, at least partially in the circumferential direction along the outer surface of the second cover 32.

As described above, air discharged backward through the outflow port 28 on the motor case 12 is guided by the guide 70 to flow forward between the outer surface 23S of the cylinder 23 in the motor case 12 and the inner surface 41T of the second cylinder 41. The air then flows onto and along the outer surface 41S of the second cylinder 41 from its front end. The rib assembly 50 guides air that has flowed onto and along the outer surface 41S of the second cylinder 41 from its front end, in the circumferential direction along the outer surface 41S.

The rib assembly 50 is fixed to the outer surface 41S of the second cylinder 41. The rib assembly 50 protrudes radially outward from the outer surface 41S. The rib assembly 50 in the embodiment includes two first rib assemblies 51, two second rib assemblies 52, and two third rib assemblies 53. The two first rib assemblies 51 are located opposite to each other in the radial direction. The two second rib assemblies 52 are located opposite to each other in the radial direction. The two third rib assemblies 53 are located opposite to each other in the radial direction.

The first rib assemblies 51 each have an inner end 51A and an outer end 51B. The inner end 51A is connected to the outer surface 41S. The outer end 51B is located radially outward from the inner end 51A. The second rib assemblies 52 each have an inner end 52A and an outer end 52B. The inner end 52A is connected to the outer surface 41S. The outer end 52B is located radially outward from the inner end 52A. The third rib assemblies 53 each have an inner end 53A and an outer end 53B. The inner end 53A is connected to the outer surface 41S. The outer end 53B is located radially outward from the inner end 53A.

Each first rib assembly 51 includes a circumferential rib 512, an inlet rib 511, and an outlet rib 513. Each circumferential rib 512 extends in the circumferential direction. Each inlet rib 511 extends in the axial direction. Each outlet rib 513 extends in the axial direction. Each inlet rib 511 is connected to a first end of the corresponding circumferential rib 512. Each inlet rib 511 protrudes frontward from the first end of the corresponding circumferential rib 512. Each inlet rib 511 guides air that has been guided by the guide 70 to the outer surface of the second cover 32 to the first end of the corresponding circumferential rib 512. Each outlet rib 513 is connected to a second end of the corresponding circumferential rib 512. Each outlet rib 513 protrudes rearward from the second end of the corresponding circumferential rib 512. Each outlet rib 513 guides air from the second end of the corresponding circumferential rib 512 rearward along the outer surface of the second cover 32.

Each second rib assembly 52 includes a circumferential rib 522, an inlet rib 521, and an outlet rib 523. Each circumferential rib 522 extends in the circumferential direction. Each inlet rib 521 extends in the axial direction. Each outlet rib 523 extends in the axial direction. Each inlet rib 521 is connected to a first end of the corresponding circumferential rib 522. Each inlet rib 521 protrudes frontward from the first end of the corresponding circumferential rib 522. Each inlet rib 521 guides air that has been guided by the guide 70 to the outer surface of the second cover 32 to the first end of the corresponding circumferential rib 522. Each outlet rib 523 is connected to a second end of the corresponding circumferential rib 522. Each outlet rib 523 protrudes rearward from the second end of the corresponding circumferential rib 522. Each outlet rib 523 guides air from the second end of the corresponding circumferential rib 522 rearward along the outer surface of the second cover 32.

Each third rib assembly 53 includes a circumferential rib 532 and an inlet rib 531. Each circumferential rib 532 extends in the circumferential direction. Each inlet rib 531 extends in the axial direction. Each inlet rib 531 is connected to a first end of the corresponding circumferential rib 532. Each inlet rib 531 protrudes frontward from the first end of the corresponding circumferential rib 532. Each inlet rib 531 guides air that has been guided by the guide 70 to the outer surface of the second cover 32 to the first end of the corresponding circumferential rib 532.

The circumferential ribs 512 in the first rib assemblies 51 are spaced from the circumferential ribs 522 in the second rib assemblies 52 in the axial direction. The circumferential ribs 522 in the second rib assemblies 52 are located rearward from the circumferential ribs 512 in the first rib assemblies 51. The circumferential rib 512 in each first rib assembly 51 partially overlaps the circumferential rib 522 in the corresponding second rib assembly 52 in a plane orthogonal to the rotation axis AX. In other words, the circumferential rib 512 in each first rib assembly 51 partially overlaps the circumferential rib 522 in the corresponding second rib assembly 52 in the axial direction.

The inlet ribs 511 in the first rib assemblies 51 are at positions different from the positions of the inlet ribs 521 in the second rib assemblies 52 in the circumferential direction.

The outlet ribs 513 in the first rib assemblies 51 are at positions different from the positions of the outlet ribs 523 in the second rib assemblies 52 in the circumferential direction.

The circumferential ribs 522 in the second rib assemblies 52 are spaced from the circumferential ribs 532 in the third rib assemblies 53 in the axial direction. The circumferential ribs 532 in the third rib assemblies 53 are located rearward from the circumferential ribs 522 in the second rib assemblies 52. The circumferential rib 522 in each second rib assembly 52 partially overlaps the circumferential rib 532 in the corresponding third rib assembly 53 in a plane orthogonal to the rotation axis AX. In other words, the circumferential rib 522 in each second rib assembly 52 partially overlaps the circumferential rib 532 in the corresponding third rib assembly 53 in the axial direction.

The inlet ribs 521 in the second rib assemblies 52 are at positions different from the positions of the inlet ribs 531 in the third rib assemblies 53 in the circumferential direction.

As described above, the rib assembly 50 includes two first rib assemblies 51, two second rib assemblies 52, and two third rib assemblies 53. One first rib assembly 51 partially overlaps one second rib assembly 52 in a plane orthogonal to the rotation axis AX. The other first rib assembly 51 partially overlaps the other second rib assembly 52 in a plane orthogonal to the rotation axis AX.

One second rib assembly 52 partially overlaps one third rib assembly 53 in a plane orthogonal to the rotation axis AX. The other second rib assembly 52 partially overlaps the other third rib assembly 53 in a plane orthogonal to the rotation axis AX.

One first rib assembly 51 does not overlap the other first rib assembly 51 in a plane orthogonal to the rotation axis AX. One first rib assembly 51 does not overlap the other second rib assembly 52 in a plane orthogonal to the rotation axis AX. One first rib assembly 51 does not overlap the other third rib assembly 53 in a plane orthogonal to the rotation axis AX.

One second rib assembly 52 does not overlap the other first rib assembly 51 in a plane orthogonal to the rotation axis AX. One second rib assembly 52 does not overlap the other second rib assembly 52 in a plane orthogonal to the rotation axis AX. One second rib assembly 52 does not overlap the other third rib assembly 53 in a plane orthogonal to the rotation axis AX.

One third rib assembly 53 does not overlap the other first rib assembly 51 in a plane orthogonal to the rotation axis AX. One third rib assembly 53 does not overlap the other second rib assembly 52 in a plane orthogonal to the rotation axis AX. One third rib assembly 53 does not overlap the other third rib assembly 53 in a plane orthogonal to the rotation axis AX.

In the embodiment, the outlet rib 513 in each first rib assembly 51 is integral with the inlet rib 531 in the corresponding third rib assembly 53. The outlet rib 513 in each first rib assembly 51 at least partially serves as the inlet rib 531 in the corresponding third rib assembly 53.

The inlet ribs 511 have the front ends located frontward from the front end of the second cylinder 41. The inlet ribs 531 have the front ends located frontward from the front end of the second cylinder 41. The inlet ribs 521 have the front ends substantially at the same position as the front end of the second cylinder 41 in the axial direction.

As shown in FIG. 8, with the first cover 31 and the second cover 32 connected together, the inlet ribs 531 have the front ends in contact with the rear surface 34R of the front plate 34 in the first cover 31. The inlet ribs 531 and the outlet ribs 513 have the radially outer ends in contact with the inner surface 33T of the first cylinder 33 in the first cover 31. This structure reduces an airflow between the first cover 31 and the outlet ribs 513 and between the first cover 31 and the inlet ribs 531. Any space may be sealed between the first cover 31 and the outlet ribs 513 and between the first cover 31 and the inlet ribs 531.

The rib assembly 50 has inlets 91, flow paths 92, and outlets 93. The inlets 91 receive air from the guide 70. The air flowing into the inlets 91 flows through the flow paths 92 in the circumferential direction. The air through the rib assembly 50 flows out through the outlets 93. In the embodiment, at least two inlets 91 are provided in the circumferential direction. At least two flow paths 92 are provided in the axial direction. At least two outlets 93 are provided in the circumferential direction.

Each inlet 91 includes an inlet 91A and an inlet 91B. Each inlet 91A is between a first rib assembly 51 and a second rib assembly 52. Each inlet 91B is between a second rib assembly 52 and a third rib assembly 53. The inlets 91A are spaced from the inlets 91B in the circumferential direction. Two inlets 91A are located around the second cylinder 41. Two inlets 91B are located around the second cylinder 41.

Each flow path 92 includes a flow path 92A and a flow path 92B. Each flow path 92A is between a first rib assembly 51 and a second rib assembly 52. Each flow path 92B is between a second rib assembly 52 and a third rib assembly 53. The flow paths 92A are spaced from the flow paths 92B in the axial direction. Two flow paths 92A are located around the second cylinder 41. Two flow paths 92B are located around the second cylinder 41.

Each outlet 93 includes an outlet 93A and an outlet 93B. Each outlet 93A is between a first rib assembly 51 and a second rib assembly 52. Each outlet 93B is between a second rib assembly 52 and a third rib assembly 53. The outlets 93A are spaced from the outlets 93B in the circumferential direction. Two outlets 93A are located around the second cylinder 41. Two outlets 93B are located around the second cylinder 41.

The inlets 91A receive air from the guide 70. Each inlet 91A is between the inlet rib 511 in a first rib assembly 51 and the inlet rib 521 in a second rib assembly 52. Each inlet 91A is defined by the front end of the second cylinder 41 between the inlet rib 511 and the inlet rib 521 and by the rear surface 34R of the front plate 34.

The inlets 91B receive air from the guide 70. Each inlet 91B is between the inlet rib 521 in a second rib assembly 52 and the inlet rib 531 in a third rib assembly 53. Each inlet 91B is defined by the front end of the second cylinder 41 between the inlet rib 521 and the inlet rib 531 and by the rear surface 34R of the front plate 34.

Each flow path 92A for air is defined partially by the circumferential rib 512 in a first rib assembly 51 and the circumferential rib 522 in a second rib assembly 52. Each flow path 92A is defined by the rear surface of the circumferential rib 512, the front surface of the circumferential rib 522, the outer surface 41S of the second cylinder 41, and the inner surface 33T of the first cylinder 33. The flow paths 92A allow air to flow in the circumferential direction.

Each flow path 92B for air is defined partially by the circumferential rib 522 in a second rib assembly 52 and the circumferential rib 532 in a third rib assembly 53. Each flow path 92B is defined by the rear surface of the circumferential rib 522, the front surface of the circumferential rib 532, the outer surface 41S of the second cylinder 41, and the inner surface 33T of the first cylinder 33. The flow paths 92B allow air to flow in the circumferential direction.

Air flows through the flow paths 92A between the first rib assemblies 51 and the second rib assemblies 52 and then flows out through the outlets 93A. Each outlet 93A is between the outlet rib 513 in a first rib assembly 51 and the outlet rib 523 in a second rib assembly 52. Each outlet 93A is defined by the outer surface 41S of the second cylinder 41 between the outlet rib 513 and the outlet rib 523 and by the inner surface 33T of the first cylinder 33.

Air flows through the flow paths 92B between the second rib assemblies 52 and the third rib assemblies 53 and then flows out through the outlets 93B. Each outlet 93B is between the outlet rib 523 in a second rib assembly 52 and an end of the circumferential rib 532 in a third rib assembly 53. Each outlet 93B is defined by the outer surface 41S of the second cylinder 41 between the outlet rib 523 and the circumferential rib 532 and by the inner surface 33T of the first cylinder 33.

Operation

The operation of the cleaner 1 according to the embodiment will now be described. The motor 10 being stopped starts running in response to the drive button 16 being operated by the user. The motor 10 runs on power supplied from the battery 7. The running motor 10 rotates the fan 11 to generate a suction force through the suction port 5. Thus, air outside the housing 2 flows into the internal space of the front housing 21 through the suction port 5.

Dust in the air is collected on the filter 19 in the internal space of the front housing 21. The air through the filter 19 is sucked into the suction port 35 in the drive unit 3.

Figure 19:
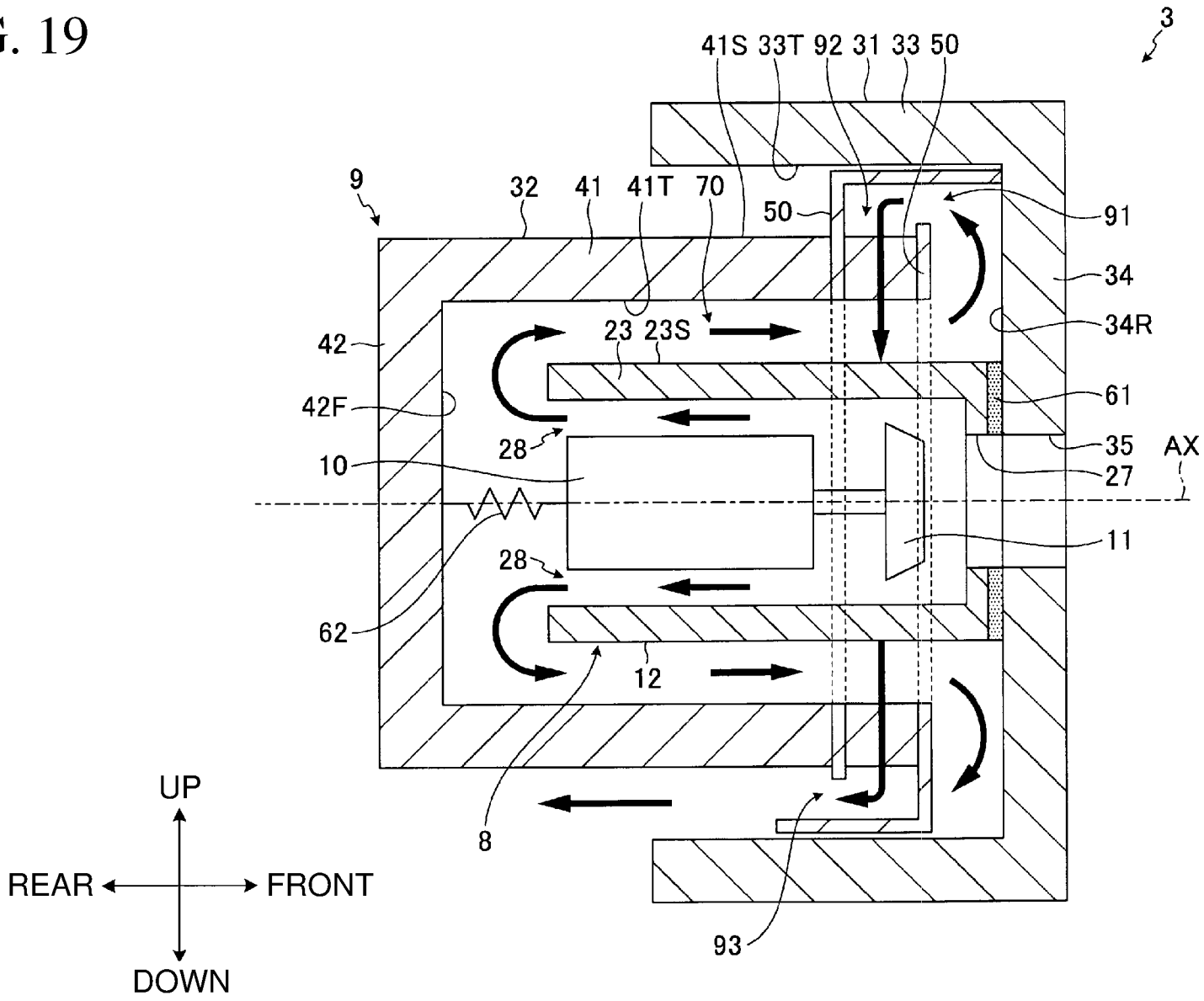
FIG. 19 is a schematic diagram of the drive unit in the embodiment, describing an airflow.

FIG. 19 is a schematic diagram of the drive unit 3 in the embodiment describing an airflow. Air is sucked into the suction port 35 as the fan 11 rotates, and flows into the internal space of the motor case 12 through the inflow port 27. The air from the fan 11 is discharged backward from the motor case 12 through the outflow port 28.

The air discharged backward through the outflow port 28 hits the front surface 42F of the rear plate 42 in the second cover 32, and then flows forward between the outer surface 23S of the cylinder 23 in the motor case 12 and the inner surface 41T of the second cylinder 41. The air hits the rear surface 34R of the front plate 34 in the first cover 31 and then flows onto and along the outer surface 41S of the second cylinder 41 from its front end through the inlets 91.

The air flowing into the inlets 91 is guided by the rib assembly 50 in the circumferential direction. The air flows in the circumferential direction through the flow paths 92 defined by the rib assembly 50. The air through the flow paths 92 then flows backward from the second cover 32 through the outlets 93. The air flowing out through the outlets 93 is then discharged from the housing 2 through the exhaust ports 6.

The rib assembly 50 guides air in the circumferential direction along the outer surface of the second cover 32. This structure allows air to travel a longer distance in the internal space of the housing 2, thus reducing noise.

In the embodiment described above, the guide 70 guides air from the fan 11 to the outer surface of the second cover 32. The rib assembly 50 guides air that has been guided by the guide 70 to the outer surface of the second cover 32, at least partially in the circumferential direction about the rotation axis AX along the outer surface of the second cover 32. This structure allows air to travel a longer distance in the internal space of the housing 2, thus reducing noise produced by the motor 10 or the fan 11. The rib assembly 50 extends in the circumferential direction on the outer surface of the second cover 32. The cleaner 1 with this structure has a smaller dimension in the axial direction.

The rib assembly 50 has the inner ends (51A, 52A, 53A) connected to the outer surface of the second cover 32, and the outer ends (51B, 52B, 53B) located radially outward from the inner ends (51A, 52A, 53A) with respect to the rotation axis AX. In other words, the rib assembly 50 protrudes radially outward from the outer surface of the second cover 32. The rib assembly 50 defines the flow paths 92 for air extending in the circumferential direction.

The rib assembly 50 includes the circumferential ribs (512, 522, 532), the inlet ribs (511, 521, 531), and the outlet ribs (513, 523). The circumferential ribs (512, 522, 532) extend in the circumferential direction about the rotation axis AX. The inlet ribs (511, 521, 531) extend in the axial direction along the rotation axis AX, and guide air that has been guided by the guide 70 to the outer surface of the second cover 32 to the first ends of the circumferential ribs (512, 522, 532). The outlet ribs (513, 523) extend in the axial direction along the rotation axis AX, and guide air from the second ends of the circumferential ribs (512, 522, 532) toward the outside of the outer surface of the second cover 32. The inlet ribs (511, 521, 531) guide air that has been guided by the guide 70 to the outer surface of the second cover 32 to smoothly flow into the flow paths 92. The circumferential ribs (512, 522, 532) form the flow paths (91, 92) extending in the circumferential direction, allowing air to flow a longer distance. The outlet ribs (513, 523) guide air that has flowed through the flow paths 92 to flow toward the outside of the outer surface of the second cover 32.

The rib assembly 50 includes the first rib assemblies 51 and the second rib assemblies 52. The circumferential ribs 512 in the first rib assemblies 51 are spaced from the circumferential ribs 522 in the second rib assemblies 52 in the axial direction along the rotation axis AX. The circumferential ribs 512 in the first rib assemblies 51 partially overlap the circumferential ribs 522 in the second rib assemblies 52 in the axial direction. Thus, the circumferential ribs 512 in the first rib assemblies 51 and the circumferential ribs 522 in the second rib assemblies 52 partially define the flow paths 92 for air extending in the circumferential direction.

The inlet ribs 511 in the first rib assemblies 51 are at positions different from the positions of the inlet ribs 521 in the second rib assemblies 52 in the circumferential direction about the rotation axis AX. Thus, the inlet ribs 511 in the first rib assemblies 51 and the inlet ribs 521 in the second rib assemblies 52 define the inlets 91 for receiving air from the guide 70. Air from the guide 70 flows into the inlets 91.

The outlet ribs 513 in the first rib assemblies 51 are at positions different from the positions of the outlet ribs 523 in the second rib assemblies 52 in the circumferential direction about the rotation axis AX. Thus, the outlet ribs 513 in the first rib assemblies 51 and the outlet ribs 523 in the second rib assemblies 52 define the outlets 93 to allow discharge of air flowing through the first rib assemblies 51 and the second rib assemblies 52. Air through the flow paths 92 flows out through the outlets 93.

The rib assembly 50 includes the third rib assemblies 53. The rib assembly 50 defines at least two flow paths 92 in the axial direction. Each flow path 92 in the embodiment includes the flow path 92A and the flow path 92B spaced from each other in the axial direction. The rib assembly 50 defines at least two inlets 91 and at least two outlets 93 in the circumferential direction. Each inlet 91 in the embodiment includes the inlet 91A and the inlet 91B spaced from each other in the circumferential direction. Each outlet 93 includes the outlet 93A and the outlet 93B spaced from each other in the circumferential direction. This structure allows air that has been guided by the guide 70 to the outer surface of the second cover 32 to branch into at least two flow paths 92. This effectively reduces noise produced by the motor 10 or the fan 11. The structure also allows the flow paths 92A and the flow paths 92B to be elongated in the circumferential direction, thus effectively reducing noise produced by the motor 10 or the fan 11.

The cover 9 includes the first cover 31 and the second cover 32 connected to the first cover 31 in a detachable manner. The first cover 31 and the second cover 32 define the internal space accommodating the motor assembly 8. As described above with reference to FIGS. 11 and 12, the motor assembly 8 is placed in the second cover 32, which is then connected to the first cover 31. The motor assembly 8 is thus accommodated in the internal space of the cover 9.

The first cover 31 includes the first cylinder 33. The second cover 32 includes the second cylinder 41. The first cover 31 and the second cover 32 are connected together to have the inner surface 33T of the first cylinder 33 and at least a part of the outer surface 41S of the second cylinder 41 facing each other. The rib assembly 50 is between the inner surface 33T of the first cylinder 33 and the outer surface 41S of the second cylinder 41. Thus, simply connecting the first cover 31 and the second cover 32 together allows the flow paths 92 to be defined by the surface of the rib assembly 50, the inner surface 33T of the first cylinder 33, and the outer surface 41S of the second cylinder 41.

The rib assembly 50 is fixed to the outer surface 41S of the second cylinder 41. Thus, simply connecting the first cover 31 to the second cover 32 including the rib assembly 50 defines the flow paths 92. The second cylinder 41 and the rib assembly 50 in the embodiment are integrally molded by, for example, injection molding. This allows efficient production of the second cover 32 including the rib assembly 50.

The motor assembly 8 includes the motor case 12 accommodating the motor 10 and the fan 11. The motor case 12 includes the inflow port 27 and the outflow port 28. The fan 11 is located frontward (in a second axial direction) from the motor 10. The inflow port 27 is at the front end (in the second axial direction) of the motor case 12. The outflow port 28 is located rearward (in a first axial direction) from the inflow port 27. This structure allows air to flow into the internal space of the motor case 12 through the inflow port 27 as the fan 11 rotates, and then to be discharged backward (in the first axial direction) from the motor case 12 through the outflow port 28.

The guide 70 in the embodiment includes the outer surface of the motor case 12 and the inner surface 41T of the second cylinder 41 facing the outer surface of the motor case 12. Air discharged backward (in the first axial direction) through the outflow port 28 on the motor case 12 then flows forward (in the second axial direction) between the outer surface of the motor case 12 and the inner surface 41T of the second cylinder 41. The air then flows onto and along the outer surface 41S of the second cylinder 41 from its front end (in the second axial direction).

The elastic member 60 is between the cover 9 and at least a part of the motor case 12 to reduce transmission of vibrations from the motor 10 or the fan 11 to the cover 9.

The elastic member 60 in the embodiment includes the first elastic member 61 and the second elastic member 62. The first elastic member 61 is at least partially located frontward (in the second axial direction) from the motor case 12. The second elastic member 62 is at least partially located rearward (in the first axial direction) from the motor case 12. The motor case 12 is supported on the cover 9 with the motor case 12 being held between the first elastic member 61 and the second elastic member 62. This effectively reduces transmission of vibrations from the motor 10 or the fan 11 to the cover 9.

The motor case 12 includes the fan cover 24 located frontward (in the second axial direction) from the fan 11. The cover 9 includes the facing surface facing at least a part of the surface of the fan cover 24. The cover 9 in the embodiment has the facing surface including the rear surface 34R of the front plate 34 in the first cover 31. The first elastic member 61 is between the surface of the fan cover 24 and the rear surface 34R of the front plate 34. This effectively reduces transmission of vibrations from the motor 10 or the fan 11 to the first cover 31.

The first cover 31 includes the suction port 35 located frontward (in the second axial direction) from the fan cover 24. The first elastic member 61 is annular and surrounds the suction port 35. This effectively reduces transmission of vibrations from the motor 10 or the fan 11 to the first cover 31 without blocking an airflow through the suction port 35.

The cover 9 has the opening 43 located rearward (in the first axial direction) from the motor case 12. The opening 43 in the embodiment is in the rear plate 42 in the second cover 32. The second elastic member 62 is connected to at least a part of the motor case 12 with the second elastic member 62 blocking the opening 43. This effectively reduces transmission of vibrations from the motor 10 or the fan 11 to the second cover 32. The second elastic member 62 blocking the opening 43 reduces leakage of air from the fan 11 though the opening 43.

The motor case 12 includes the cylinder 23 located about the rotation axis AX, and the legs 26 located radially outward from the outer surface 23S of the cylinder 23 with respect to the rotation axis AX. The second elastic member 62 is connected to the legs 26. The second elastic member 62 is at least partially located radially outward from the outer surface 23S of the cylinder 23. Thus, the second elastic member 62 can block a large opening 43 easily.

The motor assembly 8 includes the control board 13 located rearward (in the first axial direction) from at least a part of the motor case 12. The control board 13 is connected to the cable 80. The second elastic member 62 has the support hole 67 receiving the cable 80. This structure effectively reduces transmission of vibrations from the motor 10 or the fan 11 to the second cover 32 with the cable 80 supported on the second elastic member 62. The support hole 67 has an inside diameter smaller than the dimension of the opening 43. This structure reduces leakage of air from the fan 11 though the support hole 67 with the opening 43 blocked with the second elastic member 62.

The first elastic member 61 is molded integrally with the first cover 31. Thus, the first elastic member 61 is less likely to come off the first cover 31.

OTHER EMBODIMENTS

The same or corresponding components as those in the above embodiment are given the same reference numerals herein, and will be described briefly or will not be described.

Figure 20:
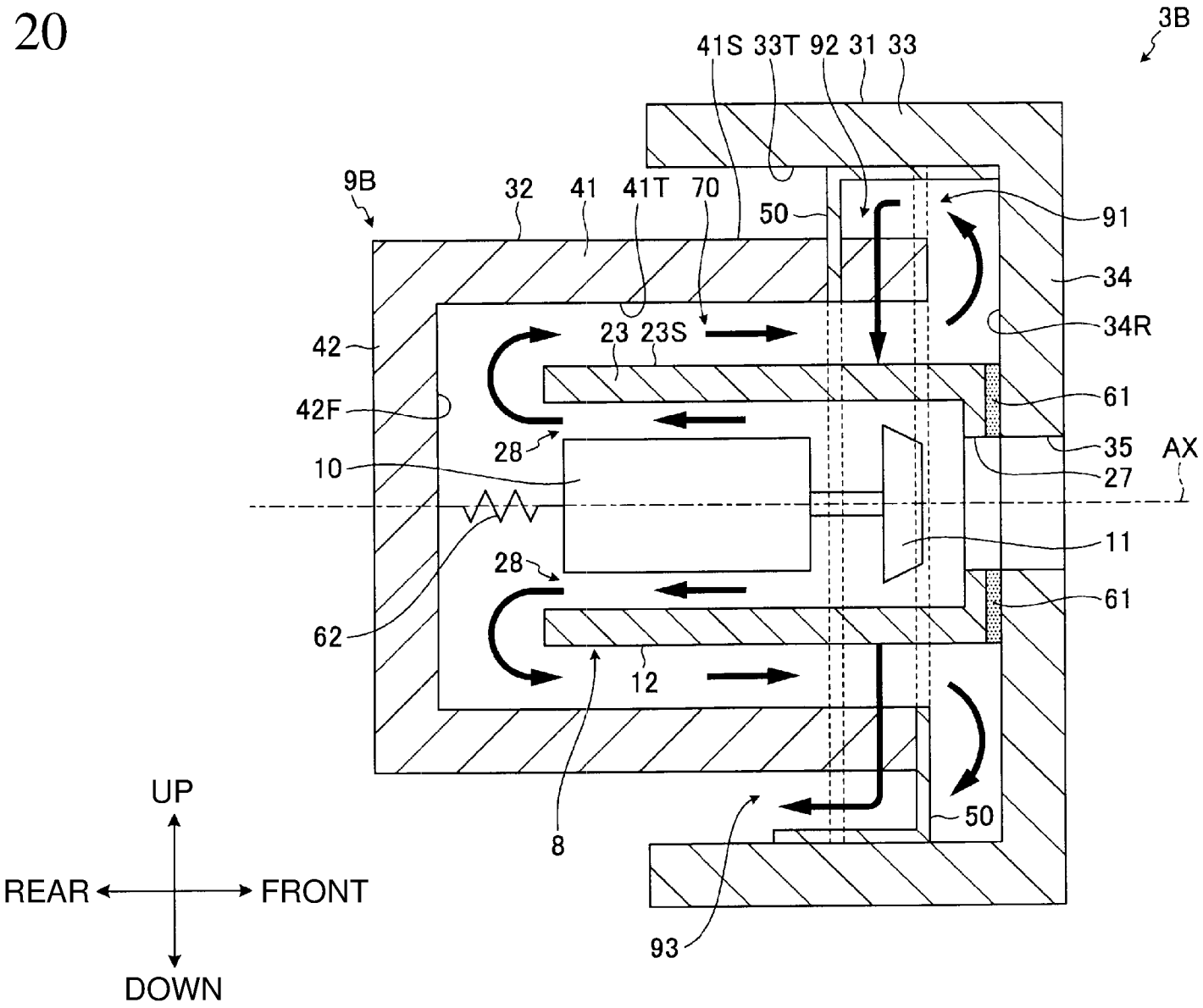
FIG. 20 is a schematic diagram of a drive unit according to another embodiment.

FIG. 20 is a schematic diagram of a drive unit 3B according to another embodiment. As shown in FIG. 20, the drive unit 3B includes the motor assembly 8, a cover 9B accommodating the motor assembly 8, and the rib assembly 50. The cover 9B includes the first cover 31 and the second cover 32. The rib assembly 50 is fixed to the inner surface of the first cover 31. In the example shown in FIG. 20, the rib assembly 50 is fixed to the inner surface 33T of the first cylinder 33. The rib assembly 50 is between the inner surface 33T of the first cylinder 33 and the outer surface 41S of the second cylinder 41. The rib assembly 50 may thus be fixed to the inner surface of the first cover 31.

Figure 21:
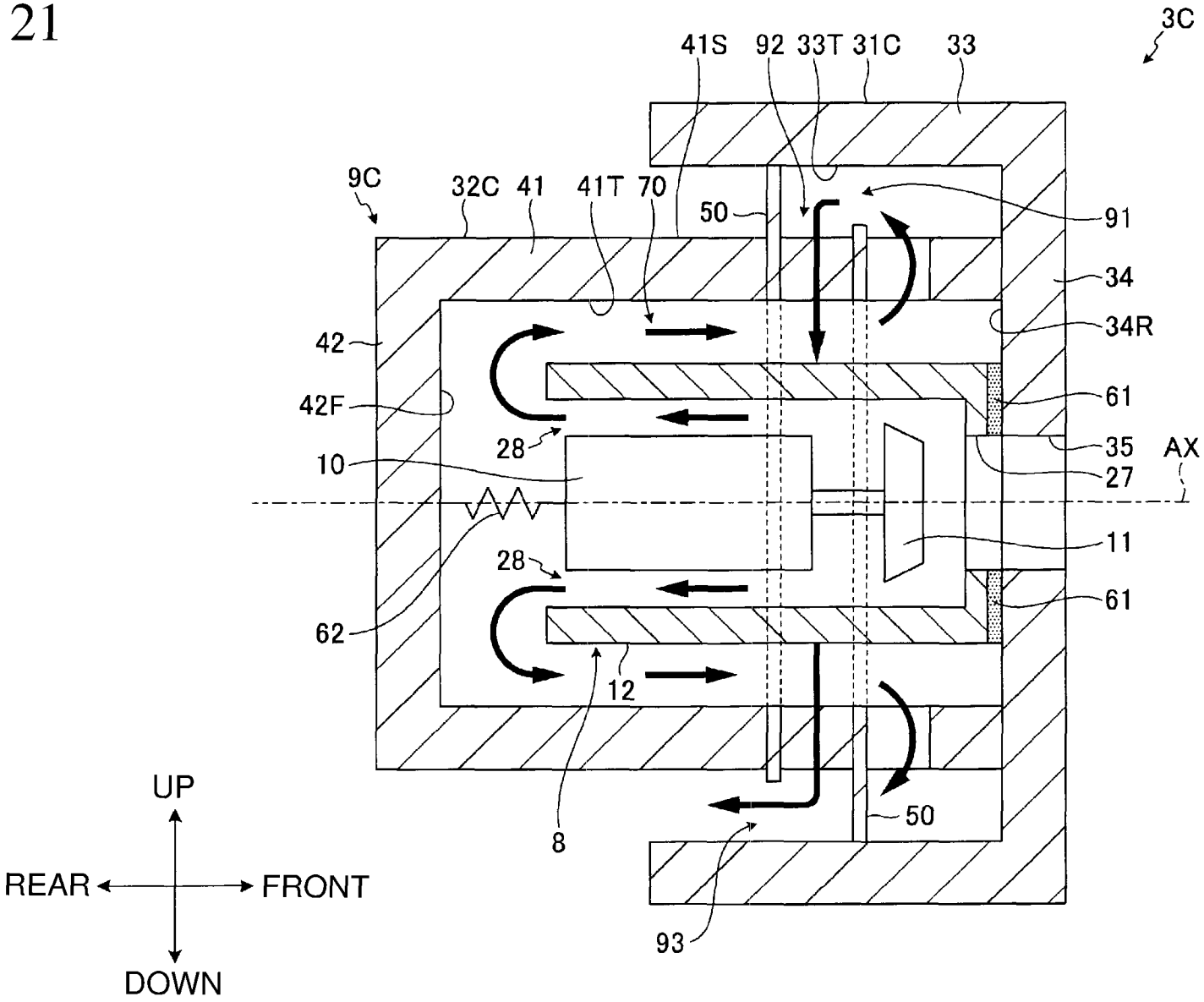
FIG. 21 is a schematic diagram of a drive unit according to still another embodiment.

FIG. 21 is a schematic diagram of a drive unit 3C according to still another embodiment. As shown in FIG. 21, the drive unit 3C includes the motor assembly 8, a cover 9C accommodating the motor assembly 8, and the rib assembly 50. The cover 9C includes a first cover part 31C and a second cover part 32C. The first cover part 31C is integral with the second cover part 32C. The first cover part 31C includes the first cylinder 33. The second cover part 32C includes the second cylinder 41. The second cylinder 41 surrounds the first cylinder 33. The rib assembly 50 is between the inner surface 33T of the first cylinder 33 and the outer surface 41S of the second cylinder 41. The cover 9C may thus include the first cover part 31C and the second cover part 32C integral with each other.

Figure 22:
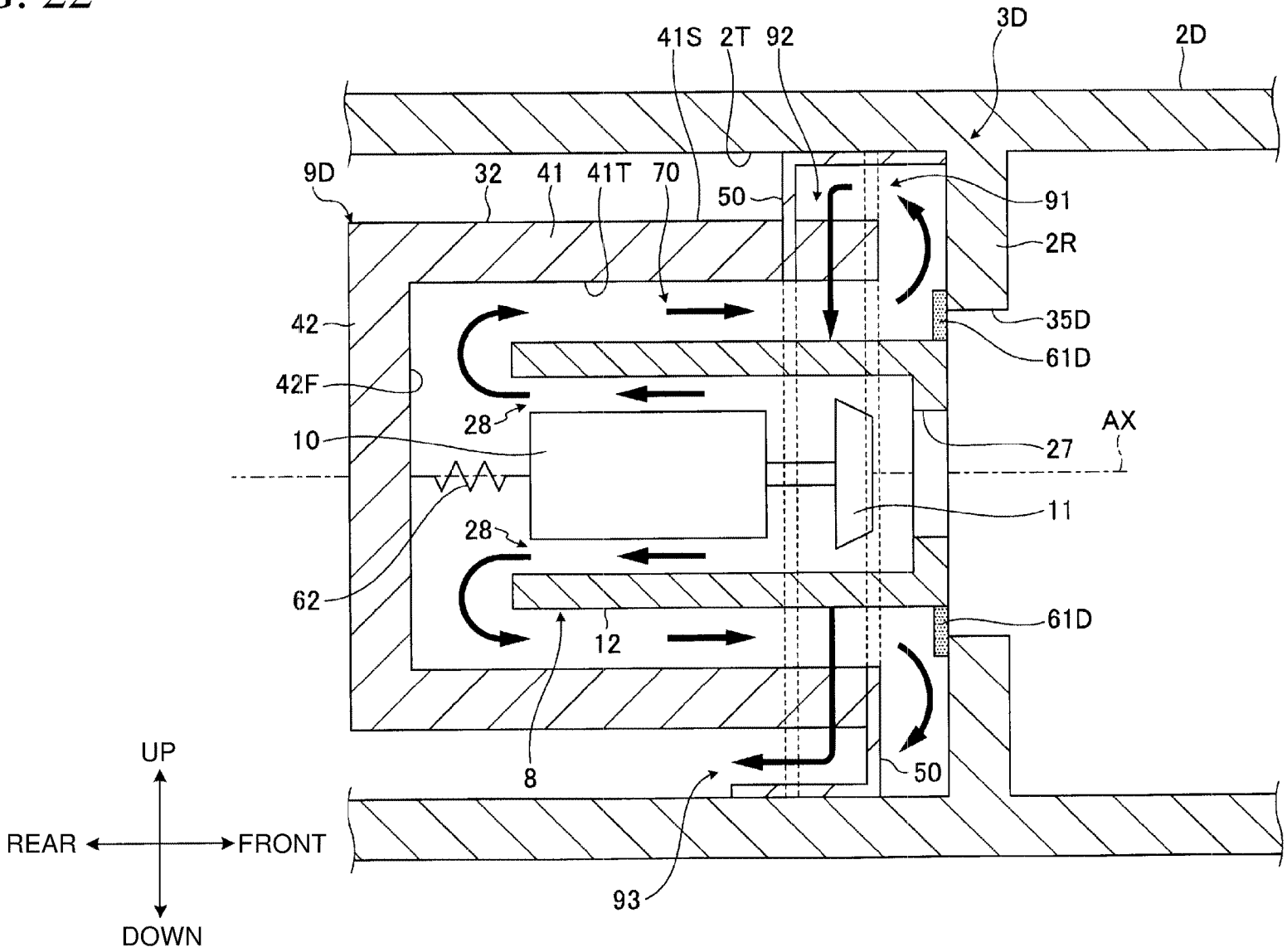
FIG. 22 is a schematic diagram of a drive unit according to still another embodiment.

FIG. 22 is a schematic diagram of a drive unit 3D according to still another embodiment. As shown in FIG. 22, the drive unit 3D includes the motor assembly 8, a cover 9D accommodating the motor assembly 8, and the rib assembly 50. The cover 9D is similar in structure to the second cover 32 described in the above embodiments. The cover 9D includes the second cylinder 41. The cover 9D is housed in a housing 2D. The rib assembly 50 is between an inner surface 2T of the housing 2D and the outer surface 41S of the second cylinder 41. The housing 2D includes a ring 2R defining a suction port 35D. The ring 2R is connected to the motor case 12 with a first elastic member 61D in between. Air flows into the inflow port 27 through the suction port 35D. The housing 2D may thus serve as the first cover 31 described in the above embodiments.

The second cover 32 and the second elastic member 62 may be integrally molded in the above embodiments.

The drive unit 3 is included in a handheld cleaner in the above embodiments. In some embodiments, the drive unit 3 may be included in a wheeled cleaner.

REFERENCE SIGNS LIST

1 cleaner
2 housing
2D housing
2R ring
2T inner surface
3 drive unit
3B drive unit
3C drive unit
3D drive unit
4 battery mount
5 suction port
6 exhaust port
7 battery
8 motor assembly
9 cover
9B cover
9C cover
9D cover
10 motor
10B base plate
10R rotor shaft
10S stator
11 fan
12 motor case
13 control board
14 handle
15 mode switch button
16 drive button
17 display
18 holder
19 filter
20 sound absorber
21 front housing
21F hook
21M opening
21L lock
21P connection pipe
22 rear housing
22C ring
22L left housing
22R right housing
22S screw
23 cylinder
23S outer surface
24 fan cover
25 support
25A cylinder
25B rear plate
25C protrusion
26 leg
27 inflow port
28 outflow port
31 first cover
31C first cover part
32 second cover
32C second cover part
33 first cylinder
33S outer surface
33T inner surface
34 front plate
34A first ring
34B second ring
34C third ring
34D rib
34F front surface
34R rear surface (facing surface)
35 suction port
35D suction port
36 flow straightener
36A fourth ring
36B fifth ring
36C sixth ring
36D rib
37 first protrusion
38 second protrusion
39 screw opening
41 second cylinder
41D recess
41S outer surface
41T inner surface
42 rear plate
42F front surface
42R rear surface
43 opening
44 boss
45 screw hole
46 pin
47 support
48 third protrusion
49 fourth protrusion
50 rib assembly
51 first rib assembly
51A inner end
51B outer end
52 second rib assembly
52A inner end
52B outer end

53 third rib assembly
53A inner end
53B outer end
511 inlet rib
512 circumferential rib
513 outlet rib
521 inlet rib
522 circumferential rib
523 outlet rib
531 inlet rib
532 circumferential rib
60 elastic member
61 first elastic member
61D first elastic member
62 second elastic member
63 first connector
64 second connector
65 blocker
66 pipe
67 support hole
70 guide
80 cable
81 screw
91 inlet
91A inlet
91B inlet
92 flow path
92A flow path
92B flow path
93 outlet
93A outlet
93B outlet
100 controller
AX rotation axis

What is claimed is:

1. A cleaner, comprising:

a motor assembly including a motor, a fan rotatable about a rotation axis with a rotational force generated by the motor, and a motor case accommodating the motor and the fan;

a motor assembly cover surrounding the motor assembly;

a guide configured to guide air from the fan at least partially to an outer surface of the motor assembly cover;

a rib assembly configured to guide the air guided by the guide at least partially in a circumferential direction about the rotation axis along the outer surface of the motor assembly cover; and a cleaner elastic member between the motor assembly cover and at least a part of the motor case; wherein the motor assembly cover includes a first cover, and a second cover connected to the first cover in a detachable manner, the first cover and the second cover define an internal space accommodating the motor assembly, the first cover includes a first cylinder, the second cover includes a second cylinder, the first cover and the second cover are connected together to have an inner surface of the first cylinder and an outer surface of the second cylinder at least partially facing each other, the rib assembly is between the inner surface of the first cylinder and the outer surface of the second cylinder, the guide includes an outer surface of the motor case and an inner surface of the second cylinder facing the outer surface of the motor case, the motor case and the second cylinder are configured such that air is discharged from the motor case in a first axial direction, flows in a second axial direction between the outer surface of the motor case and the inner surface of the second cylinder, and then flows onto and along the outer surface of the second cylinder from an end of the outer surface of the second cylinder in the second axial direction, the cleaner elastic member includes a first elastic member and a second elastic member, the first elastic member is at least partially located in the second axial direction from the motor case along the rotation axis, the second elastic member is at least partially located in the first axial direction from the motor case, the motor assembly cover has an opening located in the first axial direction from the motor case, the second elastic member is connected to at least a part of the motor case with the second elastic member blocking the opening, the motor assembly includes a control board located in the first axial direction from at least a part of the motor case, and the second elastic member has a support hole receiving a cable connected to the control board.

2. The cleaner according to claim 1, wherein the rib assembly includes an inner end connected to the outer surface of the motor assembly cover, and an outer end located radially outward from the inner end with respect to the rotation axis.

3. The cleaner according to claim 1, wherein the rib assembly includes at least one circumferential rib extending in the circumferential direction about the rotation axis, at least one inlet rib extending in an axial direction along the rotation axis to guide the air guided to the outer surface of the motor assembly cover to a first end of the at least one circumferential rib, and at least one outlet rib extending in the axial direction along the rotation axis to guide air from a second end of the at least one circumferential rib to outside the outer surface of the motor assembly cover.

4. The cleaner according to claim 3, wherein the rib assembly includes a first rib assembly and a second rib assembly, the at least one circumferential rib includes a circumferential rib included in the first rib assembly and a circumferential rib included in the second rib assembly, the circumferential rib in the first rib assembly is spaced from the circumferential rib in the second rib assembly in the axial direction along the rotation axis, the circumferential rib in the first rib assembly partially overlaps the circumferential rib in the second rib assembly in the axial direction, and the circumferential rib in the first rib assembly and the circumferential rib in the second rib assembly partially define at least one flow path for air.

5. The cleaner according to claim 4, wherein the at least one inlet rib includes an inlet rib included in the first rib assembly and an inlet rib included in the second rib assembly, the inlet rib in the first rib assembly is at a position different from a position of the inlet rib in the second rib assembly in the circumferential direction about the rotation axis, and the inlet rib in the first rib assembly and the inlet rib in the second rib assembly define at least one inlet for receiving air from the guide.

6. The cleaner according to claim 5, wherein the at least one outlet rib includes an outlet rib included in the first rib assembly and an outlet rib included in the second rib assembly, the outlet rib in the first rib assembly is at a position different from a position of the outlet rib in the second rib assembly in the circumferential direction about the rotation axis, and the outlet rib in the first rib assembly and the outlet rib in the second rib assembly define at least one outlet to allow discharge of air flowing through the first rib assembly and the second rib assembly.

7. The cleaner according to claim 6, wherein the rib assembly includes a third rib assembly, the at least one flow path includes at least two flow paths located in the axial direction, and the at least one inlet includes at least two inlets located in the circumferential direction, and the at least one outlet includes at least two outlets located in the circumferential direction.

8. The cleaner according to claim 1, wherein the rib assembly is fixed to the outer surface of the second cylinder.

9. The cleaner according to claim 1, wherein the motor case includes a fan cover located in the second axial direction from the fan, the motor assembly cover includes a facing surface facing at least a part of a surface of the fan cover, and the first elastic member is between the surface of the fan cover and the facing surface of the motor assembly cover.

10. The cleaner according to claim 9, wherein the motor assembly cover includes a suction port located in the second axial direction from the fan cover, and the first elastic member is annular and surrounds the suction port.

11. The cleaner according to claim 1, wherein the motor case includes a motor case cylinder about the rotation axis, and a leg located radially outward from an outer surface of the motor case cylinder with respect to the rotation axis, and the second elastic member is connected to the leg.

12. The cleaner according to claim 1, wherein the cleaner elastic member and the motor assembly cover are an integrally molded piece.

13. The cleaner according to claim 2, wherein the rib assembly includes at least one circumferential rib extending in the circumferential direction about the rotation axis, at least one inlet rib extending in an axial direction along the rotation axis to guide the air guided to the outer surface of the motor assembly cover to a first end of the at least one circumferential rib, and at least one outlet rib extending in the axial direction along the rotation axis to guide air from a second end of the at least one circumferential rib to outside the outer surface of the motor assembly cover.

* * * * *